US010477928B1

(12) United States Patent
Erdal

(10) Patent No.: US 10,477,928 B1
(45) Date of Patent: Nov. 19, 2019

(54) SYSTEM FOR ZIPPERS

(71) Applicant: Abdullah C. Erdal, Santa Clara, CA (US)

(72) Inventor: Abdullah C. Erdal, Santa Clara, CA (US)

( * ) Notice: Subject to any disclaimer, the term of this patent is extended or adjusted under 35 U.S.C. 154(b) by 0 days.

(21) Appl. No.: 16/180,496

(22) Filed: Nov. 5, 2018

Related U.S. Application Data

(63) Continuation-in-part of application No. 16/058,062, filed on Aug. 8, 2018, now Pat. No. 10,420,400.

(60) Provisional application No. 62/698,980, filed on Jul. 17, 2018.

(51) Int. Cl.
*A44B 19/26* (2006.01)

(52) U.S. Cl.
CPC ..... *A44B 19/26* (2013.01)

(58) Field of Classification Search
CPC ..... A44B 19/28; A44B 19/262
See application file for complete search history.

(56) References Cited

U.S. PATENT DOCUMENTS 2,224,930 A * 12/1940 Roseman ..... A44B 19/24 223/111
2,701,903 A * 2/1955 Williams ..... A44B 19/301 24/386
4,081,882 A * 4/1978 Toepelt ..... A44B 19/301 24/386
4,123,829 A * 11/1978 Takabatake ..... A44B 19/301 24/386
4,350,375 A * 9/1982 Bako ..... A44B 19/301 24/386
4,930,323 A * 6/1990 Terada ..... A44B 19/301 70/68
4,976,120 A * 12/1990 Terada ..... A44B 19/301 70/312
5,697,130 A * 12/1997 Smith ..... A44B 19/38 24/381
5,791,023 A * 8/1998 Comerford ..... A44B 19/36 24/386
6,510,593 B1 * 1/2003 Kim ..... A44B 19/301 24/382
7,293,334 B2 11/2007 Metzger
7,304,600 B2 12/2007 Nehls et al.
7,506,417 B2 * 3/2009 Yoneoka ..... A44B 19/301 24/386
8,079,625 B2 12/2011 Arney et al.
8,484,764 B2 * 7/2013 Damon ..... A44B 19/38 2/108
8,764,081 B1 7/2014 Krieger
9,027,210 B2 5/2015 Peters et al.
9,149,092 B2 10/2015 Damon et al.
9,706,816 B2 7/2017 Coakley et al.
(Continued)

*Primary Examiner* — Robert Sandy
*Assistant Examiner* — David M Upchurch

(57) ABSTRACT

An apparatus for joining two pieces of material comprises a zipper slider along with a right-hand-side bottom stop and a left-hand side bottom stop to stop the zipper slider. The zipper slider has an outer-face width, and the right-hand-side bottom stop and left-hand side bottom stop each include a front face having a portion that extends beyond the outer-face width of the slider. The zipper slider is topped with a slider holder that includes various electronics such as a light, a speaker, a microphone, a GPS device, and a Bluetooth device.

14 Claims, 26 Drawing Sheets

(56) References Cited

U.S. PATENT DOCUMENTS

| | | | | |
|---|---|---|---|---|
| 2006/0112523 | A1* | 6/2006 | Deto | A41F 1/002 24/303 |
| 2006/0164280 | A1* | 7/2006 | Nehls | G08C 17/02 341/176 |
| 2006/0218758 | A1* | 10/2006 | Chang | A44B 19/262 24/431 |
| 2007/0135953 | A1* | 6/2007 | Crow | H04R 5/023 700/94 |
| 2009/0077774 | A1* | 3/2009 | Lee | G08B 3/10 24/381 |
| 2010/0038276 | A1* | 2/2010 | Chen | A44B 19/24 206/527 |
| 2010/0313387 | A1* | 12/2010 | Peters | A44B 19/38 24/381 |
| 2013/0061436 | A1* | 3/2013 | Peters | A44B 99/00 24/430 |
| 2015/0136552 | A1* | 5/2015 | Mercado | A45C 13/18 190/101 |
| 2018/0324509 | A1* | 11/2018 | Muller, III | G08B 21/18 |

* cited by examiner

SYSTEM FOR ZIPPERS

CROSS REFERENCE TO RELATED APPLICATIONS

This application claims priority to U.S. Provisional Patent Application No. 62/698,980 filed on Jul. 17, 2018 entitled "Improved System for Zippers," the contents of which are hereby incorporated by reference in their entirety, and U.S. patent application Ser. No. 16/058,062 entitled "Improved System for Zippers," the contents of which are hereby incorporated by reference in their entirety.

BACKGROUND

Most zippers are used to connect two materials, including two pieces of fabric, together. To do this, zippers typically require a slider that is connected to a first piece of fabric, leaving the second piece of fabric free to be inserted into the slider through insertion pin. Once the second piece of fabric is inserted into the slider, the zipper can be "zipped," or pulled up (or in any direction that closes the zipper), thereby connecting the two materials. Unfortunately, this typical configuration can be difficult for young children, older adults, and others who lack manual dexterity.

FIG. 1 is a face-down view of an example of the prior-art. In this drawing, the zipper system includes a top tape 1 (also called right-hand tape), and a bottom tape 13 (also called left-hand tape). Top tape 1 is connected to the first piece of fabric (not shown), while bottom tape 13 is connected to the second piece of fabric (not shown). The connections can be with thread, glue, or any other known method, including being woven integrally into their respective pieces of fabric.

Chain or zipper teeth 6 are in two halves, with each half in fixed contact with each of top tape 1 and bottom tape 13, respectively. The zipper shown in FIG. 1 includes slider 3 that is slidably coupled to one half of chain 6, and thereby coupled to the first piece of fabric. When moved to an extreme lower position, slider 3 is stopped by bottom stop 7.?

FIG. 2 is a close-up view of one end of a zipper system. When in use, insertion pin 10 is inserted through slider 3 and into retainer box 11 in a way that aligns each half of the zipper chain so that when slider 3 is moved, the two halves of chain 6 are forced together to connect the first piece of fabric to the second piece of fabric.

In both FIGS. 1 and 2, to move slider 3 along chain 6, a user can grasp pull tab (also called a puller) 4, which is connected to slider 3, and is configured to be pulled in one direction or another, colloquially called "up" (the direction in which slider 3 is moved to connect the two halves of chain 6) and "down" (the direction in which slider 3 is moved to separate the connected halves of chain 6).

When the zipper is fully zipped up, slider 3 is found at the end of the zipper chain, and is stopped by top stop 2.

FIGS. 3 and 4 display a perspective view of slider 3 with pull tab 6. FIG. 3 includes slider 3, which is a single piece, with a top piece 21 that includes a hinge connection 23 for pull tab 6, and a bottom 22 connected to top 21. Bottom 22 is typically connected by a physical connection within the interior of slider 3. Slider 3 further includes slider gap 24, which allows slider 3 to slide up and down a zipper chain, but is constrained by the width of the zipper chain which is typically wider than the slider gap 24.

FIG. 4 is a bottom view of slider 3, that includes bottom piece 22, top piece 21, pull tab 6, and slider gap 24.

In both FIGS. 3 and 4, one can see that lower opening 204 is unitary, and is configured to allow inclusion of a both halves of a chain to sit side by side, with one half of the chain inserted using an insertion pin.

FIG. 5 displays the same slider as in FIGS. 3 and 4, and shows upper opening 205. As can be seen in FIG. 5, upper opening 205 is in two halves to accommodate each half of a chain.

FIG. 6 shows an upper and lower exploded view of slider 3. As can be seen in this FIG. 6, top piece 301 and bottom piece 302 are unified by splitter 303, situated between and in contact with both top piece 301 and bottom piece 302. As is shown in FIG. 6, splitter 303 is roughly wedge shaped and extends only a portion of the way from one end of splitter 303 to the other end of splitter 303 such that one end of the slider includes two openings, each opening configured to receive a half a zipper chain; the other end of splitter 303 includes a single opening configured to allow the joined halves of the zipper chain to pass through when physically connected to form a single zipper chain.

FIG. 7 is a perspective view of slider 3, from the top, showing top 701, bottom 702, gap 703, and lower opening 704.

As discussed above, users with limited manual dexterity may have trouble using existing zippers. They may have trouble inserting an insertion pin into a slider, or they may have trouble manipulating the pull tab, or even holding the bottom stop as they zip up the zipper. Thus, a need exists to provide a zipper apparatus that works with many of the existing components of current zippers, but allows for easier use by those with limited manual dexterity.

SUMMARY OF THE INVENTION

Embodiments of the present invention provide a solution for combining two pieces of material that are appropriate for being combined by a zipper. Exemplary embodiments of the present invention that are shown in the drawings are summarized below. These and other embodiments are more fully described in the Detailed Description section. It is to be understood, however, that there is no intention to limit the invention to the forms described in this Summary of the Invention or in the Detailed Description. One skilled in the art can recognize that numerous modifications, equivalents, and alternative constructions exist, each that fall within the spirit and scope of the invention as expressed in the claims.

Generally, embodiments of the present invention include a system configured to provide a user with the ability to combine to materials together using zipper teeth. In one illustrative embodiment of the present invention, an apparatus comprises a right-hand-side bottom stop that includes a right-hand-side front face and a right-hand-side inner face. The right-hand-side inner face includes a slot configured to receive an insertion pin. The apparatus further includes a left-hand side bottom stop that includes a left-hand-side front face and an insertion pin configured to be inserted into the right-hand-side inner face. A zipper slider with an outer-face width, is configured to slide down a zipper chain until it contacts the right-hand-side bottom stop. The right-hand-side front face is configured to have a portion that extends beyond the outer-face width of the slider.

In another embodiment, a zipper slider is configured to slide along a zipper chain, and includes a slider holder coupled to the zipper slider and configured to include a housing with external faces. At least one light source is placed on at least one of the external faces, and an actuator button is electrically coupled to the at least one light source, and placed on at least one of the right-hand-side front face, the right-hand-side bottom face, and the right-hand-side inner face.

BRIEF DESCRIPTION OF THE DRAWINGS

The structure and the technical means adopted by the present invention to achieve the above and other objects can best be understood by referring to the following detailed description of certain embodiments and the accompanying drawings, wherein.

DETAILED DESCRIPTION

For the purposes of the present invention, LHS is synonymous with "left-hand side" and "left hand," and RHS is synonymous with "right-hand side" and "right hand."

Figure 1:
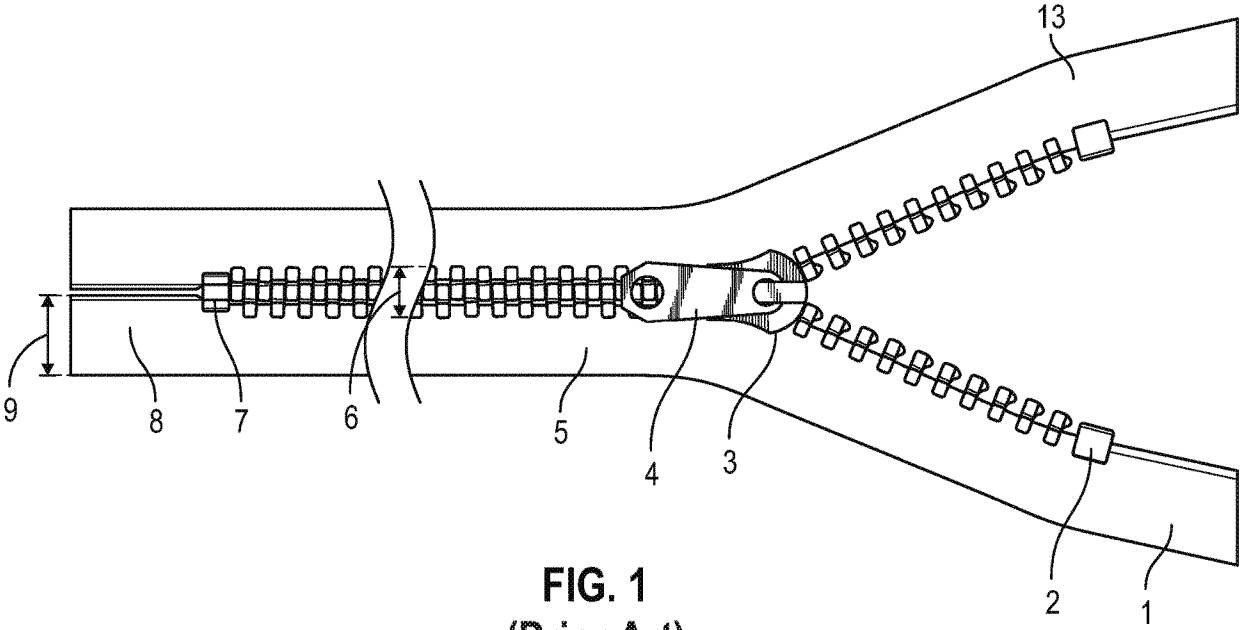
FIG. 1 (Prior Art)
FIG. 1 illustrates a view of a prior-art embodiment of components of a zipper.
Figure 2:
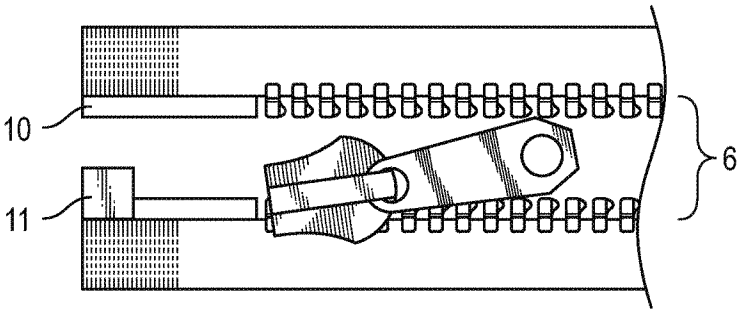
FIG. 2 (Prior Art)
FIG. 2 illustrates a close-up view of a prior-art embodiment of components of a zipper.
Figure 4:
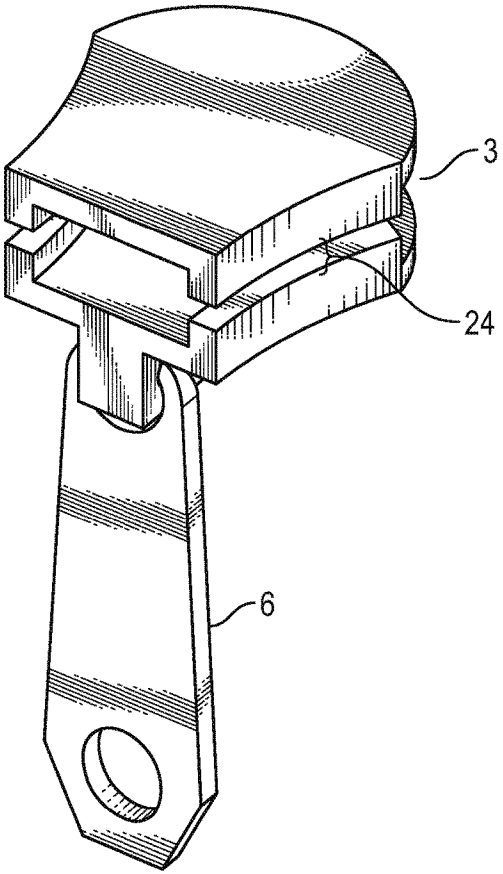
FIG. 4 (Prior Art)
FIG. 4 illustrates a perspective face-down view of a prior-art embodiment of a zipper slider with a pull tab.
Figure 3:
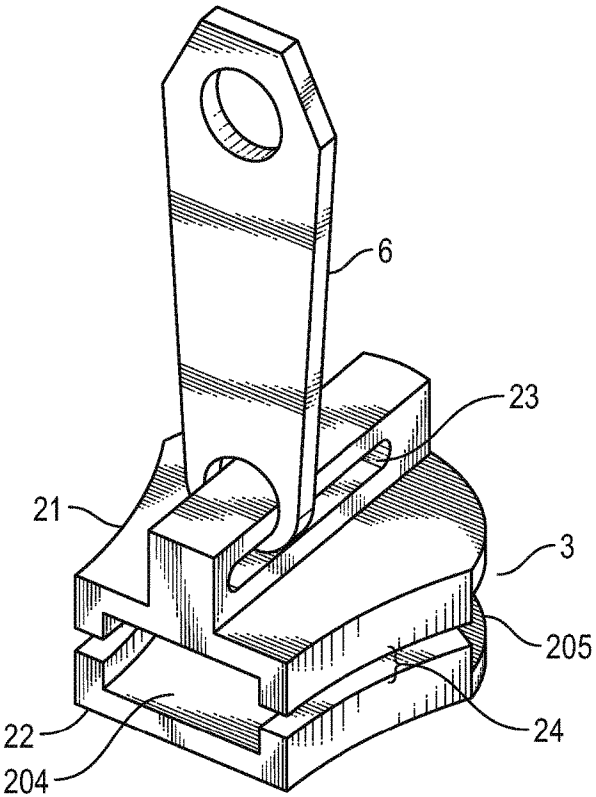
FIG. 3 (Prior Art)
FIG. 3 illustrates a perspective face-up view of a prior-art embodiment of a zipper slider with a pull tab.
Figure 5:
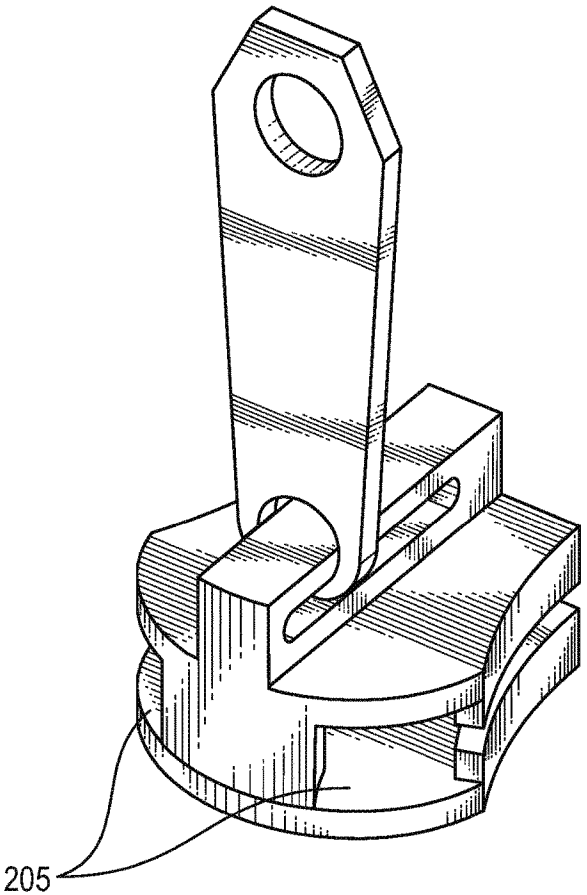
FIG. 5 (Prior Art)
FIG. 5 illustrates a perspective face-up view of a prior-art embodiment of a zipper slider with a pull tab.
Figure 6:
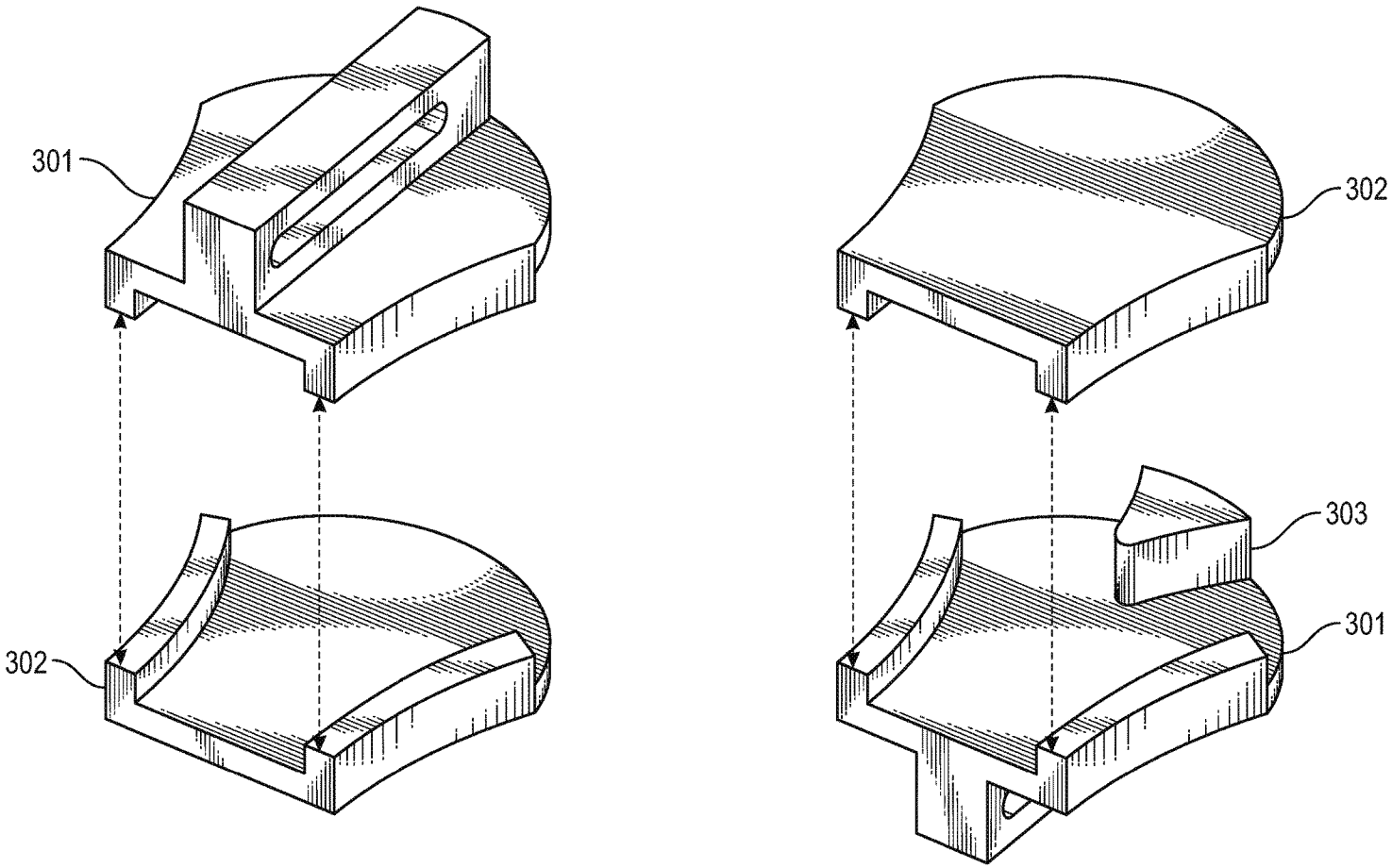
FIG. 6 (Prior Art)
FIG. 6 illustrates a perspective exploded view of a prior-art embodiment of a zipper.
Figure 7:
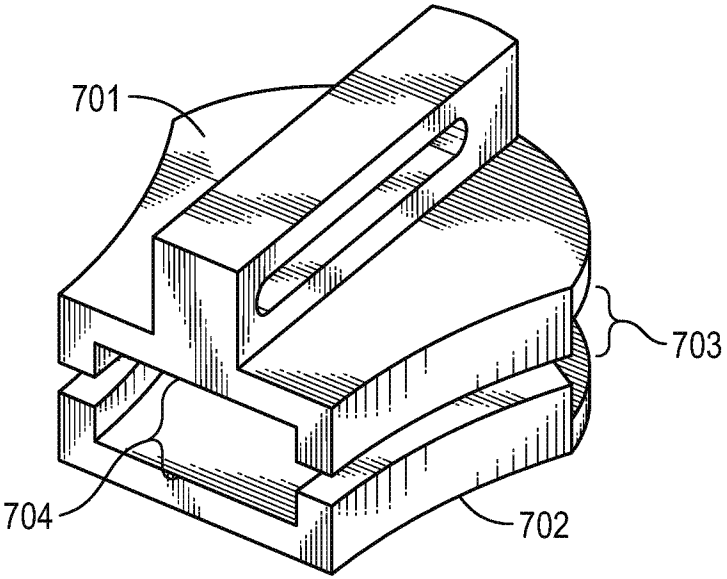
FIG. 7 (Prior Art)
FIG. 7 illustrates a perspective view of a prior-art embodiment of a slider.
Figure 8:
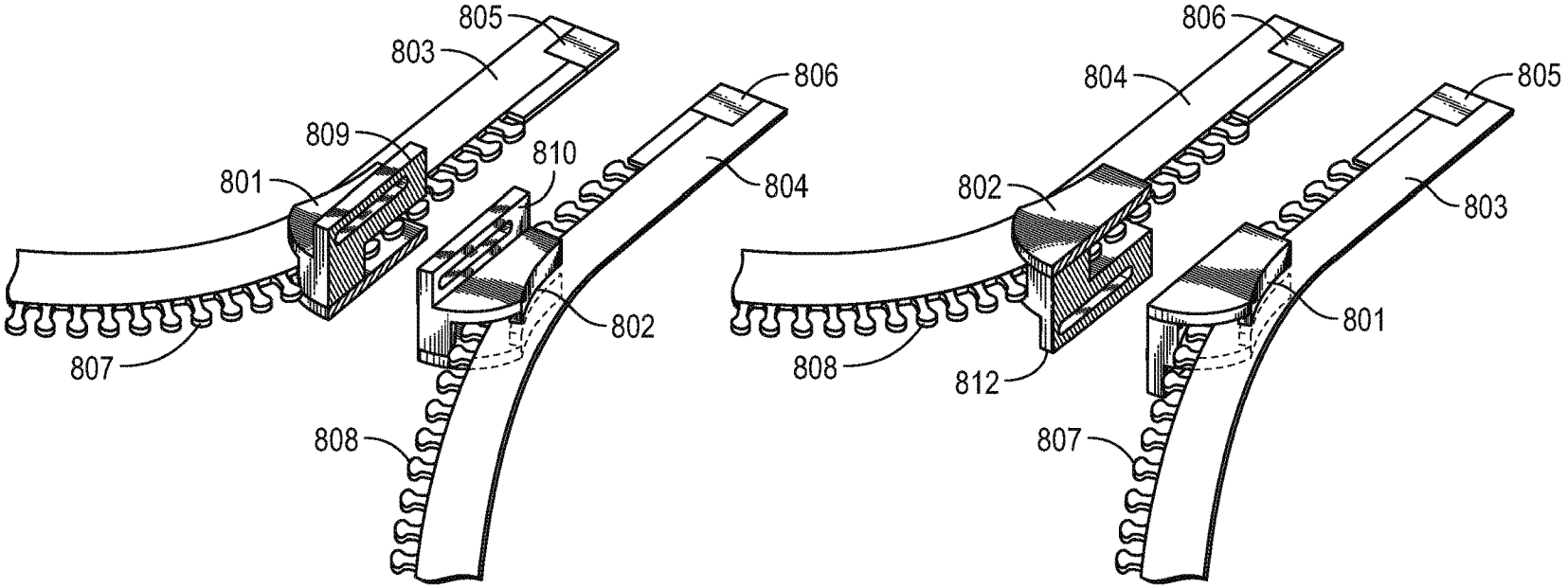
FIG. 8 illustrates an embodiment of the invention, including a top and bottom view of left and right parts of a split slider with a left and right zipper chain.

FIG. 8 displays both a top and bottom perspective view of an embodiment of the present invention that includes LHS slider 801, RHS slider 802, LHS tape 803, RHS tape 804, LHS bottom stop 805, RHS bottom stop 806. In this embodiment, LHS slider 801 is slidably coupled to LHS zipper teeth 807, and can extend as far as LHS bottom stop 805, which prevents LHS slider 801 from sliding off LHS tape 803. Likewise, RHS slider 802 is slidably coupled to RHS zipper teeth 808, and can extend as far as RHS bottom stop 806, which prevents RHS slider 802 from sliding off RHS tape 804. In one embodiment, LHS slider 801 includes a LHS pull tab loop 809. In another embodiment, RHS slider 802 includes a RHS pull tab loop 810. In yet another embodiment, both RHS and LHS sliders include a pull tab loop.

In an embodiment, LHS slider 801 includes left-hand contact face 811, which is configured to be in contact with right-hand contact face 812 on RHS slider 802. Once in contact along their respective contact faces, LHS slider 801 and RHS slider 802 are configured to act as a traditional zipper slider, that is, a single or unitary slider, and is capable of zipping up, combining zipper chains 807 and 808, and unzipping, or disconnecting, the combined zipper chains back into separate zipper chain 807 and 808.

Figure 9:
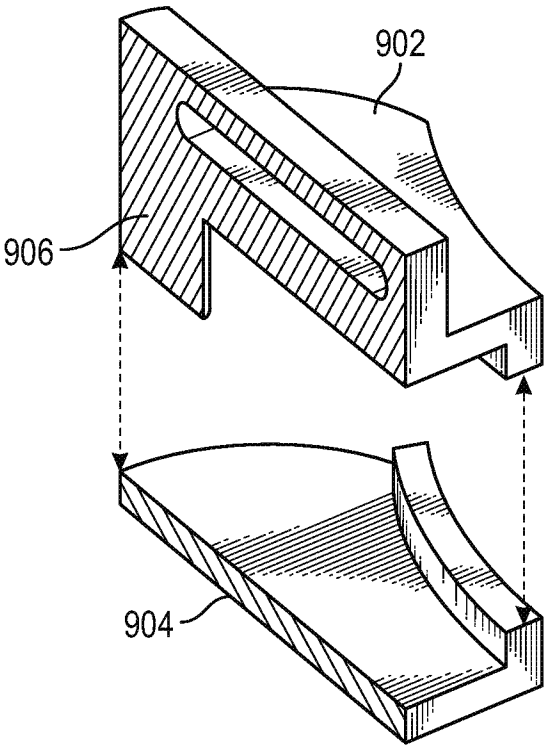
FIG. 9 illustrates an exploded view of an embodiment of the invention including left-hand zipper slider and a right-hand zipper slider.
Figure 9:
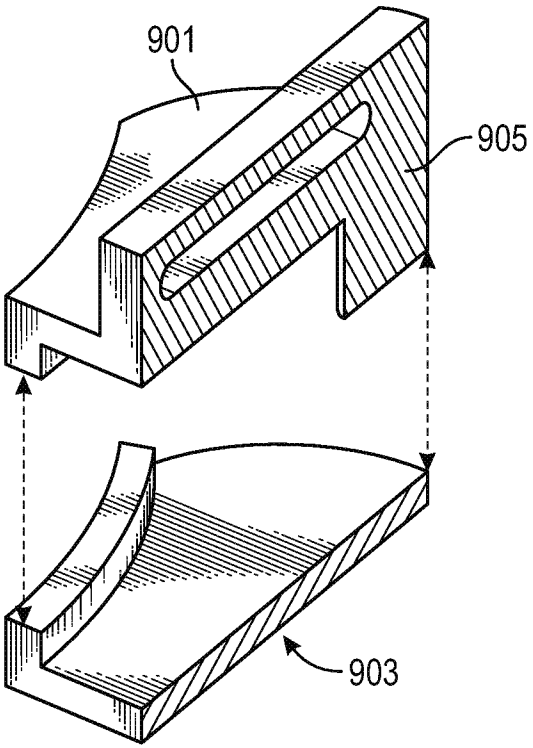

FIG. 9 is an exploded view of both an LHS slider and an RHS slider, according to an embodiment. LHS slider includes LHS top piece 901, LHS bottom piece 903, both held together by LHS, or left-hand, splitter 905. In an embodiment, RHS slider includes RHS top piece 902, RHS bottom piece 904, and RHS splitter 906. In an embodiment, LHS top piece 901 is fixedly connected to LHS bottom piece 903 by LHS splitter 905; RHS top piece 902 is fixedly connected to RHS bottom piece 904 by RHS splitter 906. In an embodiment, LHS splitter 905 is formed as part of the LHS top piece 901, and RHS splitter 906 is formed as part of RHS top piece 902. In an embodiment, LHS splitter 905 can be formed as part of LHS bottom piece 903, and RHS splitter 906 can be formed as part of RHS bottom piece 904. In another embodiment, LHS splitter 905 and RHS splitter 906 are formed individually and attached to its respective bottom or top piece.

Regardless of how LHS splitter 905 and RHS splitter 906 are formed, when each is in contact with the other, they act as a single traditional splitter. In an embodiment, LHS splitter 905 is shaped as one half of a substantially wedge-shaped splitter, while RHS splitter 906 is shaped as the other half of a substantially wedge-shaped splitter.

Figure 10:
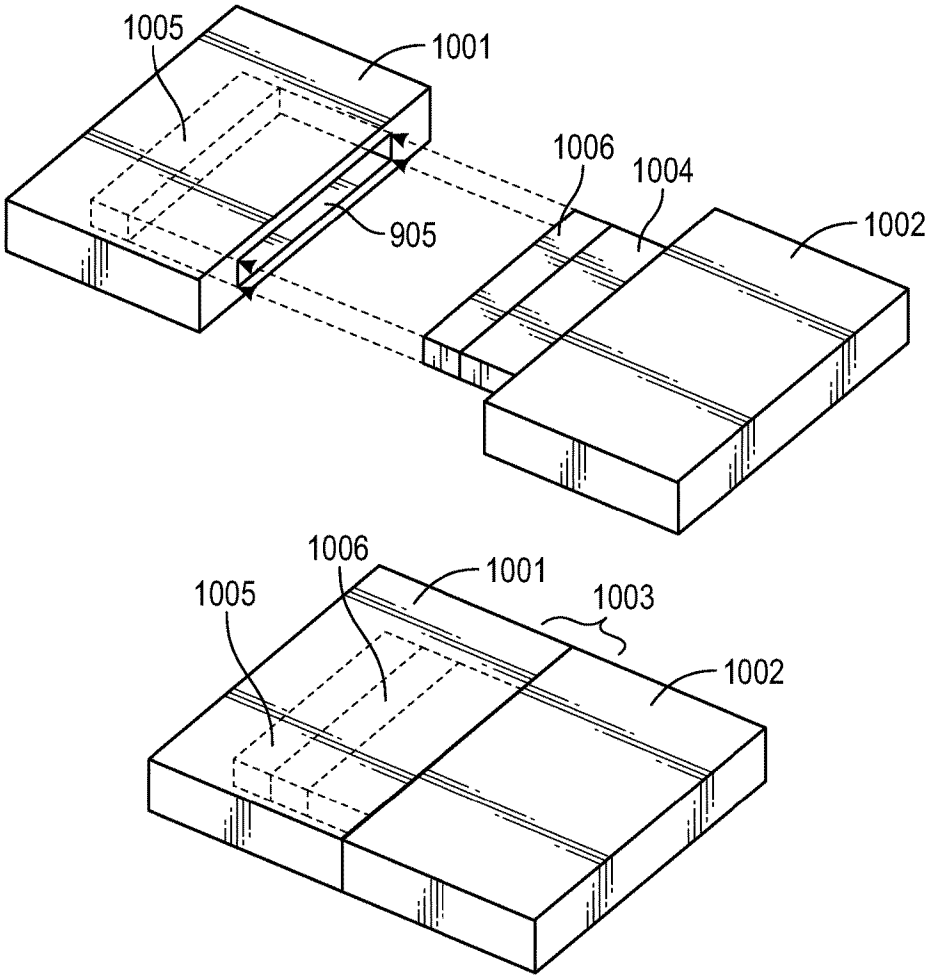
FIG. 10 illustrates an embodiment of the present invention including a left-hand, or female slider holder, and a right-hand, or male slider holder.

FIG. 10 displays an embodiment of the invention including female slider holder 1001, male slider holder 1002, and the combined slider holder 903 where male slider holder 1002 is inserted into female slider holder 1001, creating a single slider holder. In this embodiment, male slider 1002 includes insertion tab 1004, and is configured to be inserted into slot 1005.

Figure 11:
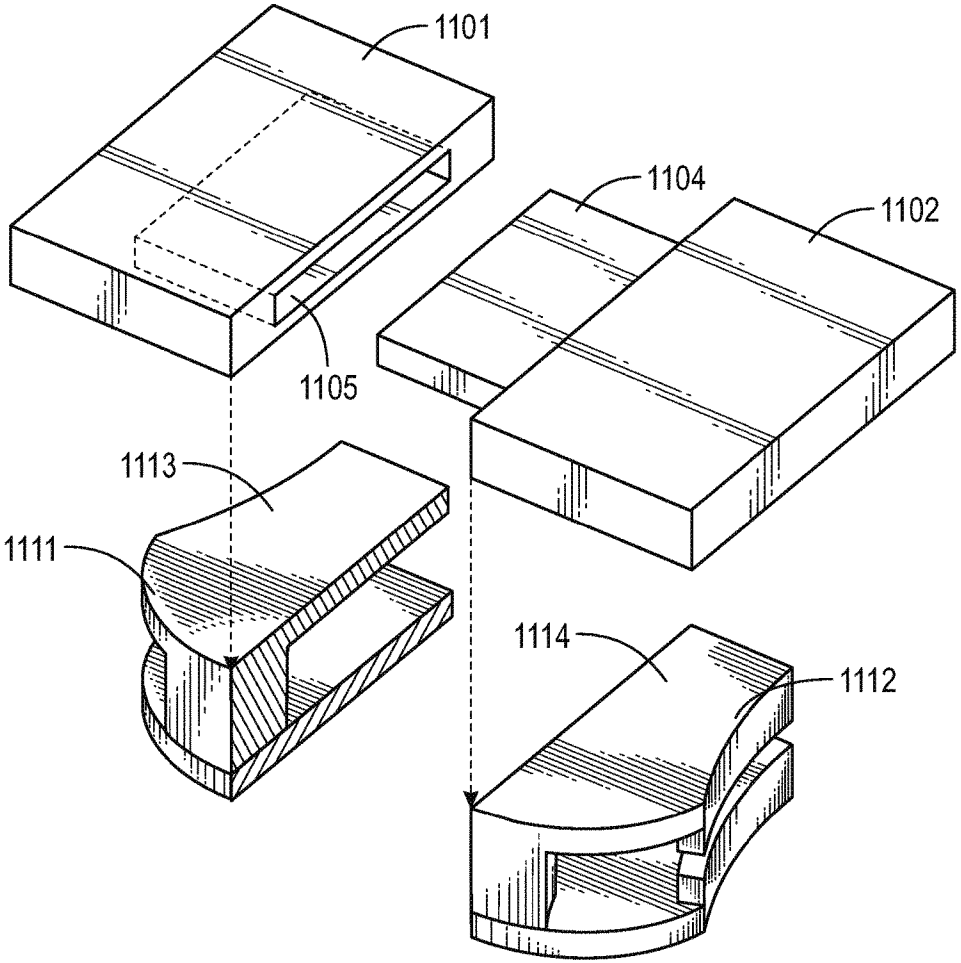
FIG. 11 illustrates an embodiment of the invention including a male and female slider holder paired with a right and left side slider part.

FIG. 11 displays an embodiment in which female slider holder 1101, also called RHS slider holder 1101, is configured to be attached to the upper face 1113 of RHS slider 1111, and male slider holder 1102, also called LHS slider holder 1102, is configured to be attached to the upper face 1114 of LHS slider 1112. In another embodiment, female slider holder 1101 is manufactured as part of RHS slider 1111, and male slider holder 1102 is manufactured as part of LHS slider 1112, rather than being manufactured individually and then attached afterwards. In an embodiment, insertion tab 1104 is configured to be inserted into slot 1105 such that, when insertion tab 1104 is inserted into slot 1005, RHS slider 1111 and LHS slider 1112 are placed in communication in a way that allows them to function as a single slider.

Figure 12:
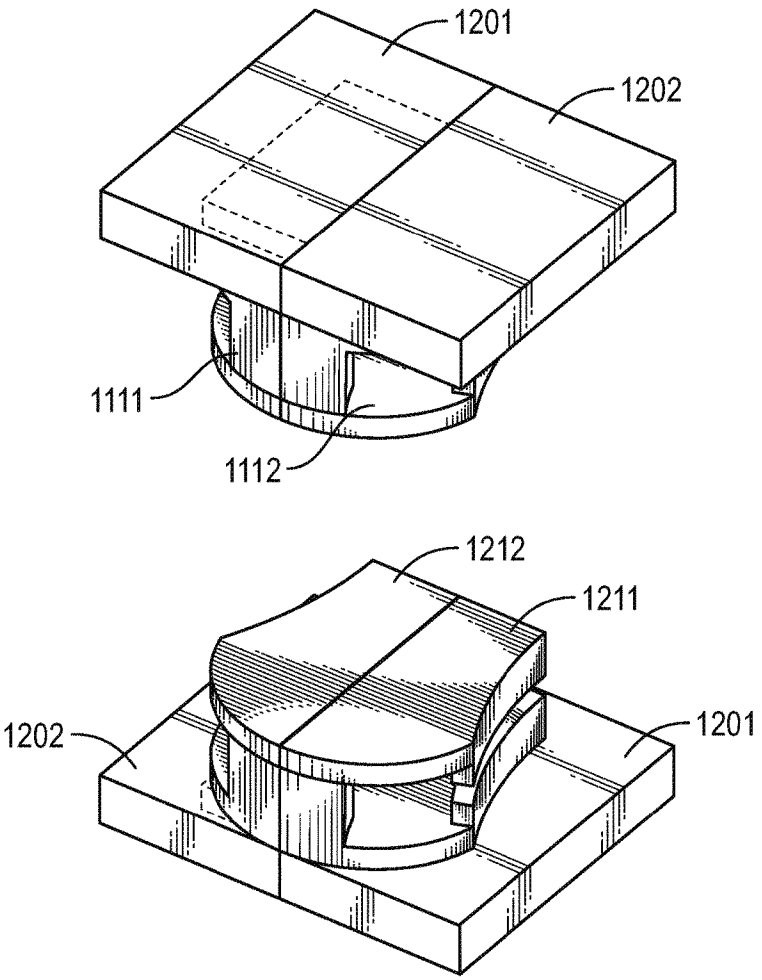
FIG. 12 illustrates an embodiment of the invention including a bottom-front and top-front view of a slider joined to a slider holder.

FIG. 12 displays a perspective view of an embodiment of the present invention in which female slider holder 1201 is connected to RHS slider 1211, and male slider holder 1202 is connected to LHS slider 1212. In an embodiment, male slider 1202 is connected to female slider holder 1201, allowing RHS slider 1201 and LHS slider 1202 to function as a unitary or single slider. One skilled in the art will understand that female slider holder 1201 can also be called LHS slider holder, and male slider holder 1202 can also be called RHS slider holder.

Figure 13:
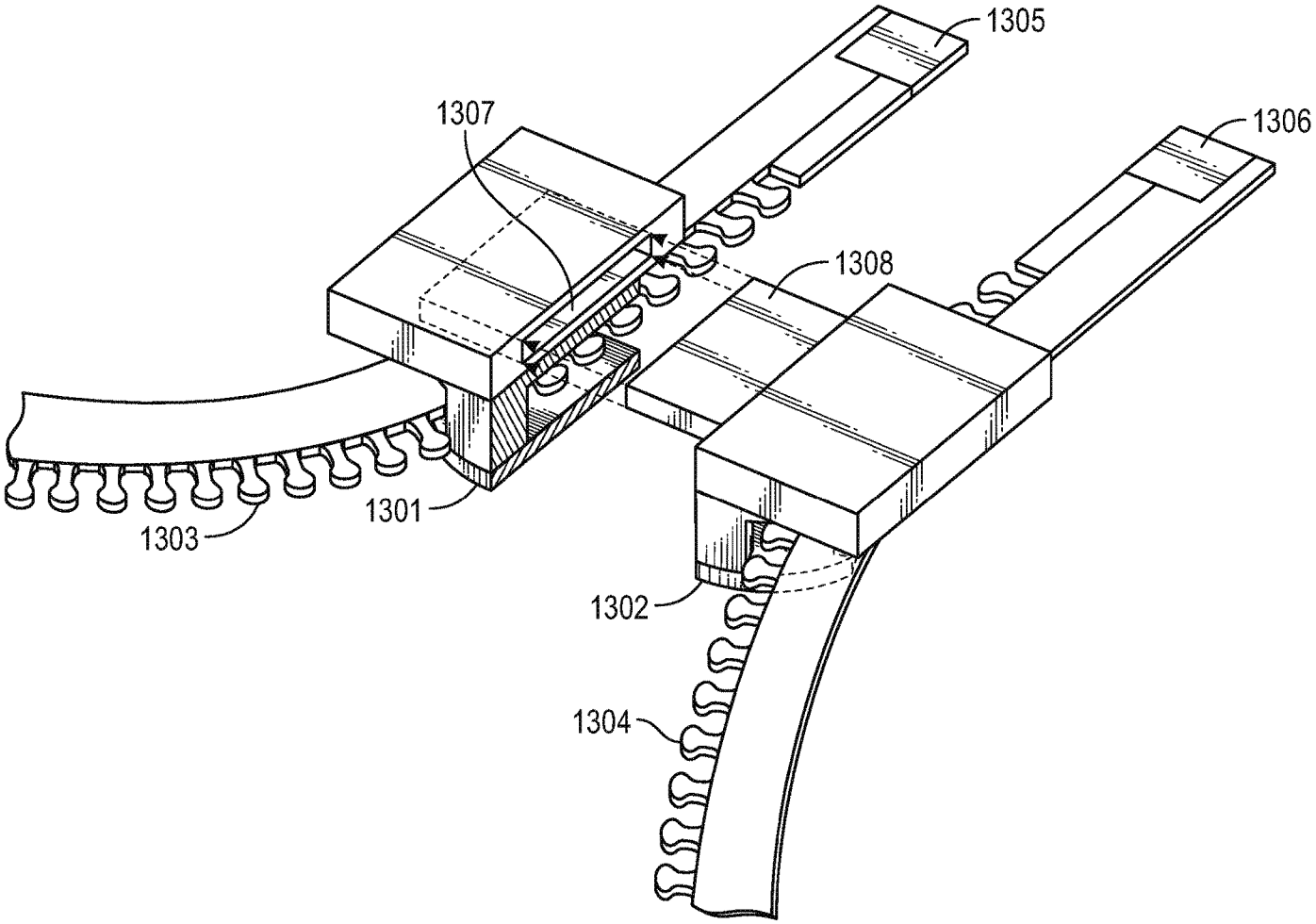
FIG. 13 illustrates an embodiment of the invention including a front view of a left-hand slider holder connected to the top of a left-hand slider that is slidably connected to a left-hand zipper chain, and a right-hand slider holder connected to the top of a right-hand slider that is slidably connected to a right-hand zipper chain.

FIG. 13 is an embodiment of the invention showing a top view of the zipper mechanism. In this embodiment, LHS slider 1301 is coupled to LHS zipper teeth 1303, and RHS slider 1302 is coupled to RHS zipper teeth 1304. To fully zip the zipper from top to bottom, in this embodiment, both LHS slider 1301 and RHS slider 1302 are positioned in contact with LHS stopper 1305 and RHS stopper 1306. Next, insertion tab 1308 is inserted into slot 1307, forming a single slider capable, when moved, of attaching LHS zipper teeth 1203 to RHS zipper teeth 1304.

Figure 14:
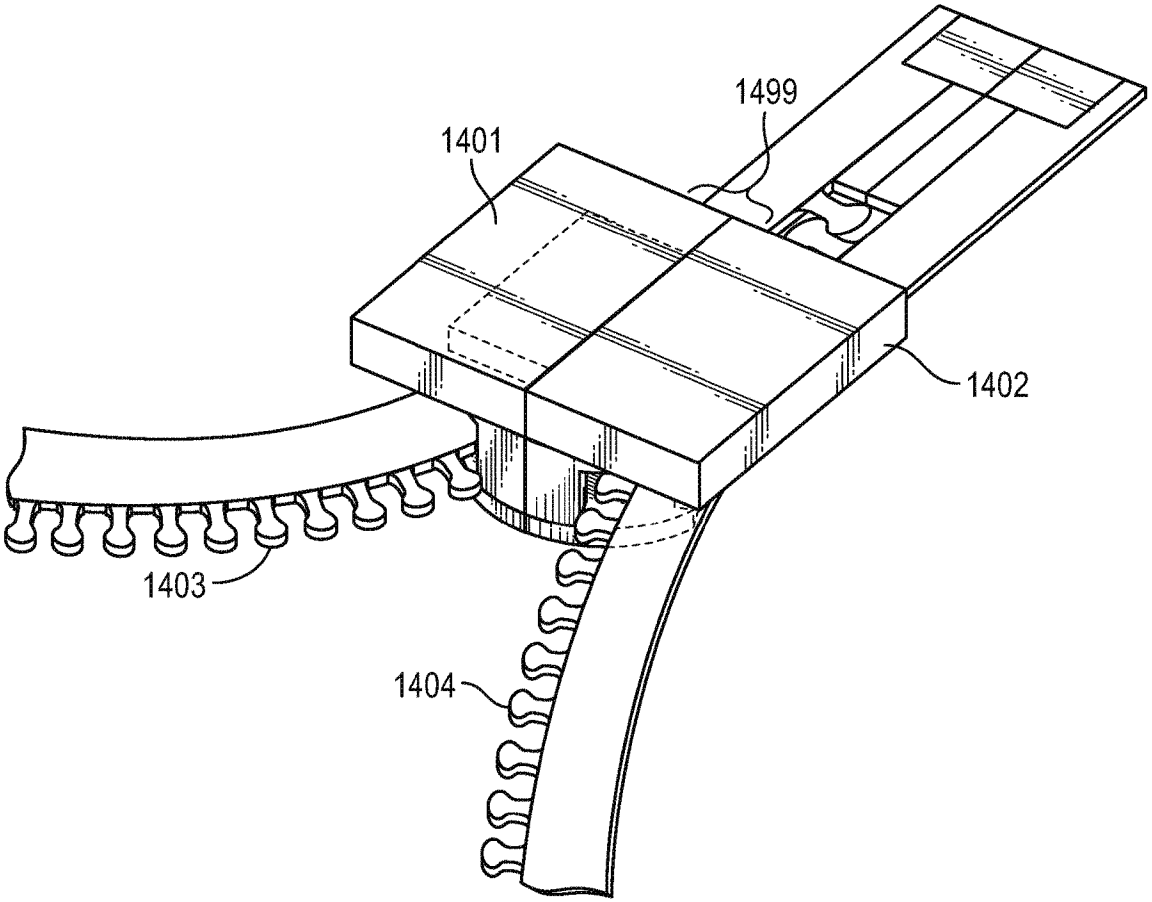
FIG. 14 illustrates an embodiment of the invention including a front view of a left-hand slider and left-hand slider holder connected to a right-hand slider and right-hand slider holder.

FIG. 14 is an embodiment of the invention showing LHS slider 1401 and RHS slider 1402 connected together to form single slider 1499. In this figure, single slider 1499 has been slid partially along zipper teeth 1403 and 1404, forcing them together to join the two sides.

Figure 15:
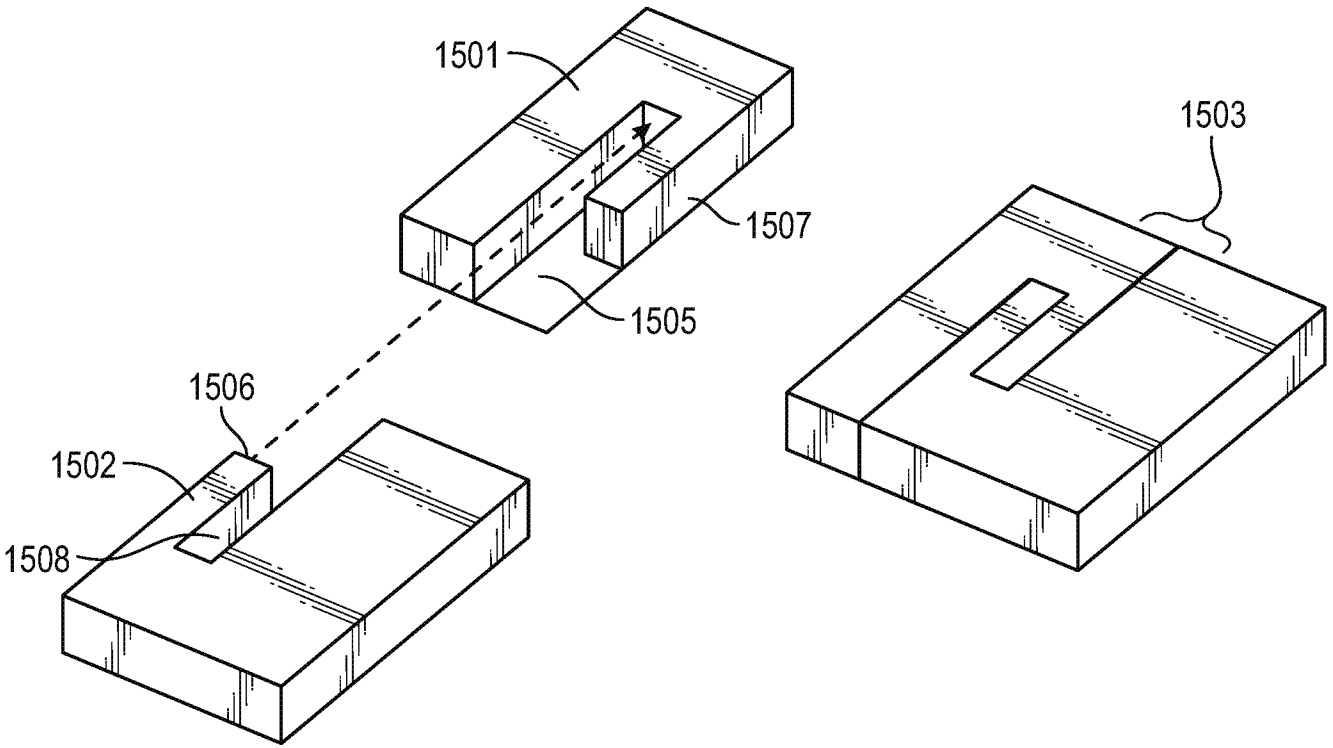
FIG. 15 illustrates an embodiment of the invention including a left-hand slider holder and a right-hand slider holder, and a slot and tab assembly for joining the two pieces together.

FIG. 15 is an embodiment of the invention showing a method of attaching LHS slider holder 1501 to RHS slider holder 1502 to form unitary slider holder 1503. In this embodiment, LHS slider holder 1501 include substantially u-shaped left-hand cut-out area 1505, also called slot 1505, configured to receive right-hand tab 1506. In addition, RHS slider holder 1502 includes a substantially u-shaped right-hand cut-out area 1508 configured to receive left-hand tab 1507 such that, when placed together, allows for formation of a unit that functions as a single slider. In one embodiment, LHS slider holder 1501 and RHS slider holder 1502 are formed separately from the LHS slider and the RHS slider, as is shown in 13D. In another embodiment, LHS slider holder 1501 and RHS slider holder 1502 are formed integrally with the LHS and RHS slider, forming a single LHS piece and a single RHS piece. In an embodiment, the left-hand cut-out area forms left-hand tab 1507, and right-hand cut-out area forms right-hand tab 1506.

Figure 16:
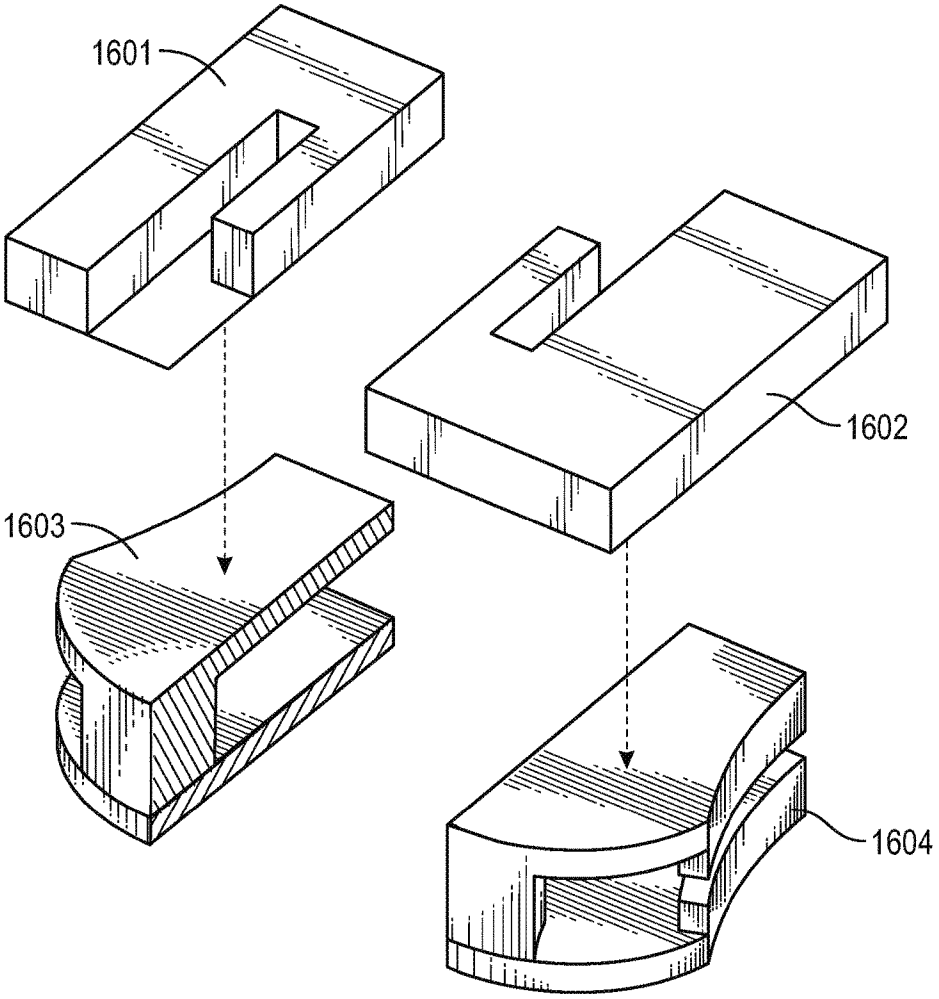
FIG. 16 illustrates an embodiment of the invention displaying the relationship between a left-hand and right-hand slider holder and a left-hand and right-hand slider, respectively.
Figure 17:
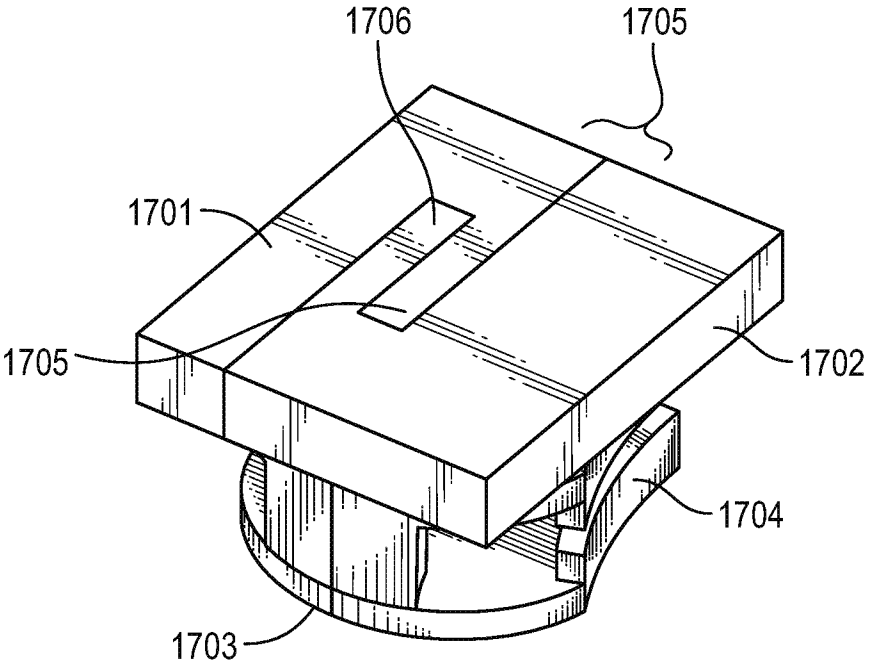
FIG. 17 illustrates an embodiment of the invention including a joined left-hand slider holder and right-hand slider holder.

FIG. 16 displays an embodiment of the invention showing the relationship between LHS slider holder 1601 and RHS slider 1603, and also the relationship between RHS slider holder 1602 and RHS slider 1604, according to an embodiment of the invention. FIG. 17 displays a perspective view of an embodiment of the invention showing LHS slider holder connected to LHS slider 1703, locked in place with RHS slider holder 1702, which is connected to RHS slider 1704. In this embodiment, LHS slider holder 1701 couples with RHS slider holder 1702 to form a single slider holder 1703. In this embodiment, insertion tab 17606 inserts into slot 1705, thus locking together the two halves.

Figure 18:
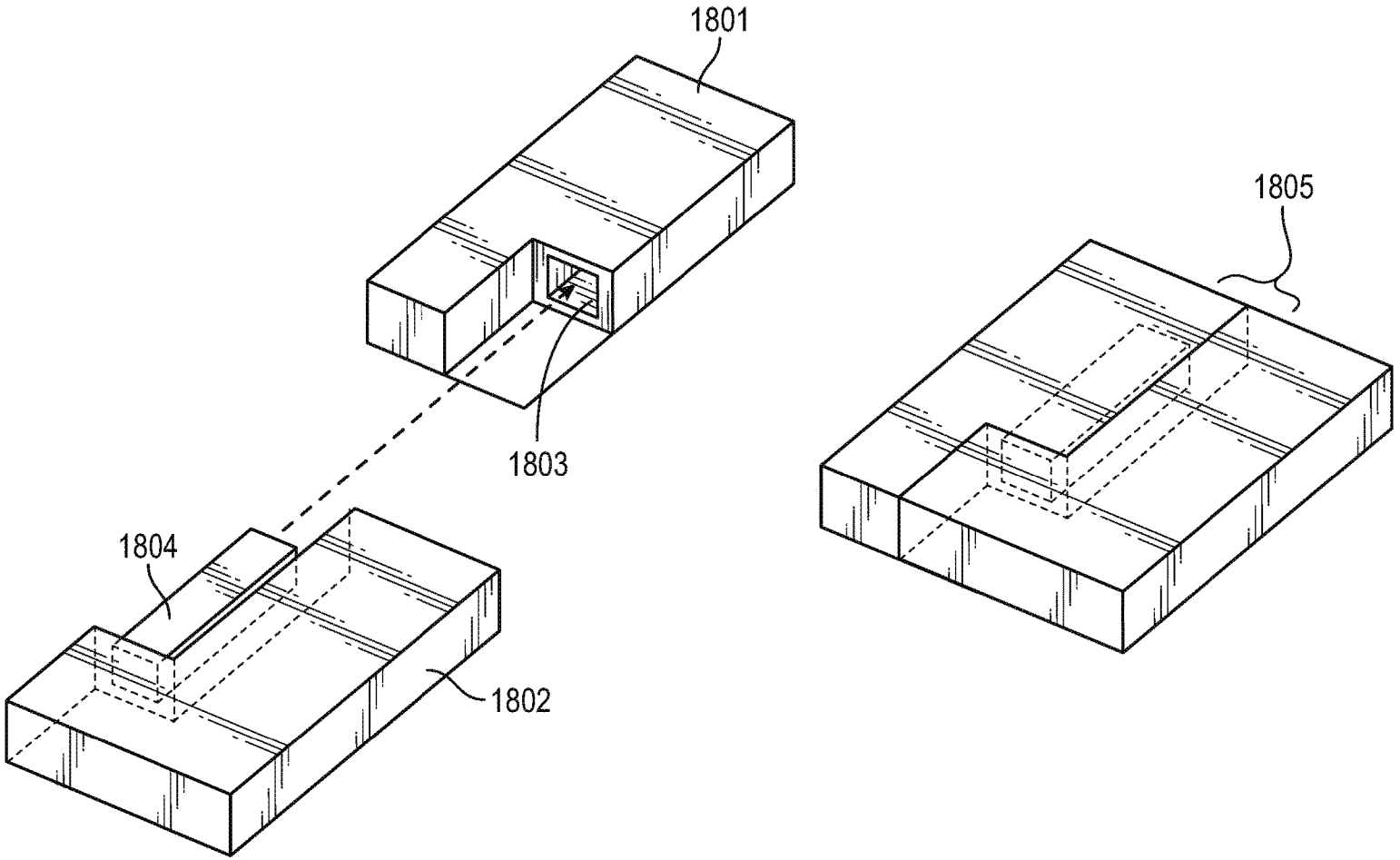
FIG. 18 illustrates an embodiment of the invention including a slider-holder assembly including a slot and tab configuration.

FIG. 18 displays an embodiment of the invention that includes LHS slider holder 1801 configured to couple with RHS slider holder 1802 to form a single slider holder 1805. In this embodiment, insertion tab 1804 inserts into slot 1803, thus locking together the two halves to form unitary piece 1805, according to an embodiment. In an embodiment, slot 1804 is internal to LHS slider holder 1801 and is substantially rectangular in cross section; insertion tab 1804 is external to RHS slider holder 1803, and is also substantially rectangular in cross section such that insertion tab 1804 is configured to fit into slot 1803.

Figure 19:
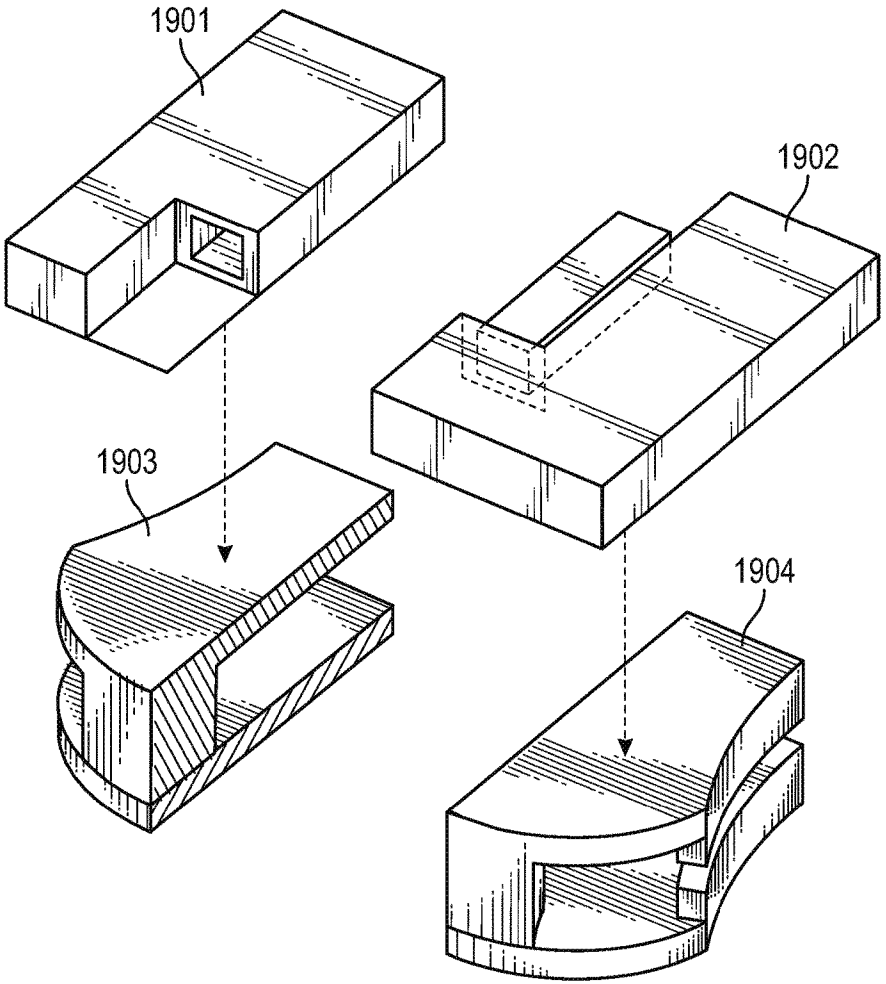
FIG. 19 illustrates an embodiment of the invention displaying the relationship between a slider holder and its respective slider part.

FIG. 19 displays LHS slider holder 1901 and its relationship to LHS slider 1903, along with RHS slider holder 1902 and its relationship to RHS slider 1904, according to an embodiment. In an embodiment, each slider holder is attached to its respective slider through some kind of adhesive, magnet, weld, or any other practicable way of connecting a slider holder to a slider. In an embodiment a slider holder and its respective slider are manufactured in such a way that the slider holder and slider form a unitary piece.

Figure 20:
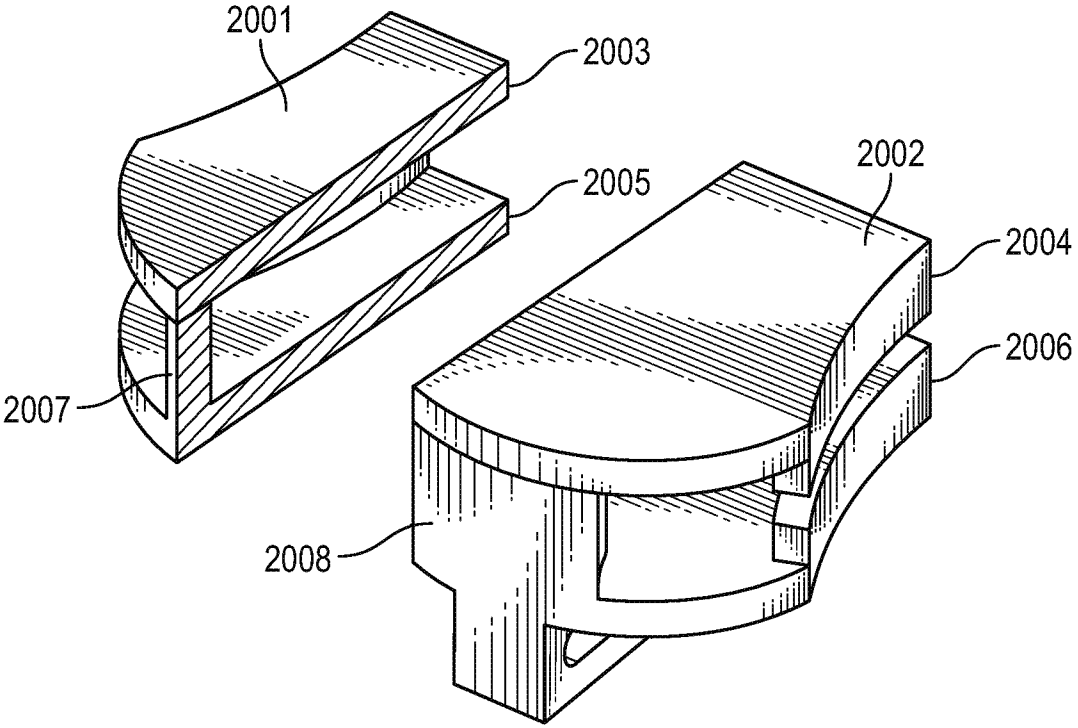
FIG. 20 illustrates an embodiment of the invention including a slider assembly with an asymmetric configuration, including splitter asymmetrically divided between each slider piece.

FIG. 20 displays a perspective view of an embodiment in which LHS slider holder 2001 and RHS slider holder 2002 are not equally sized, and are symmetric in neither their shape nor their function. In an embodiment, the LHS slider and slider holder need not be symmetric with the RHS slider and RHS slider holder, as long as the two sides, acting together, preserve the zipper functionality. In an embodiment, LHS slider includes LHS top piece 2003 and LHS bottom piece 2005, along with LHS splitter 2007 situated between and serving as a connection between, LHS top piece 2003 and LHS bottom piece 2005. RHS slider includes RHS top piece 2004 and RHS bottom piece 2006, along with RHS splitter located between, and serving as a connection between, RHS top piece 2004 and RHS bottom piece 2006.

Figure 21:
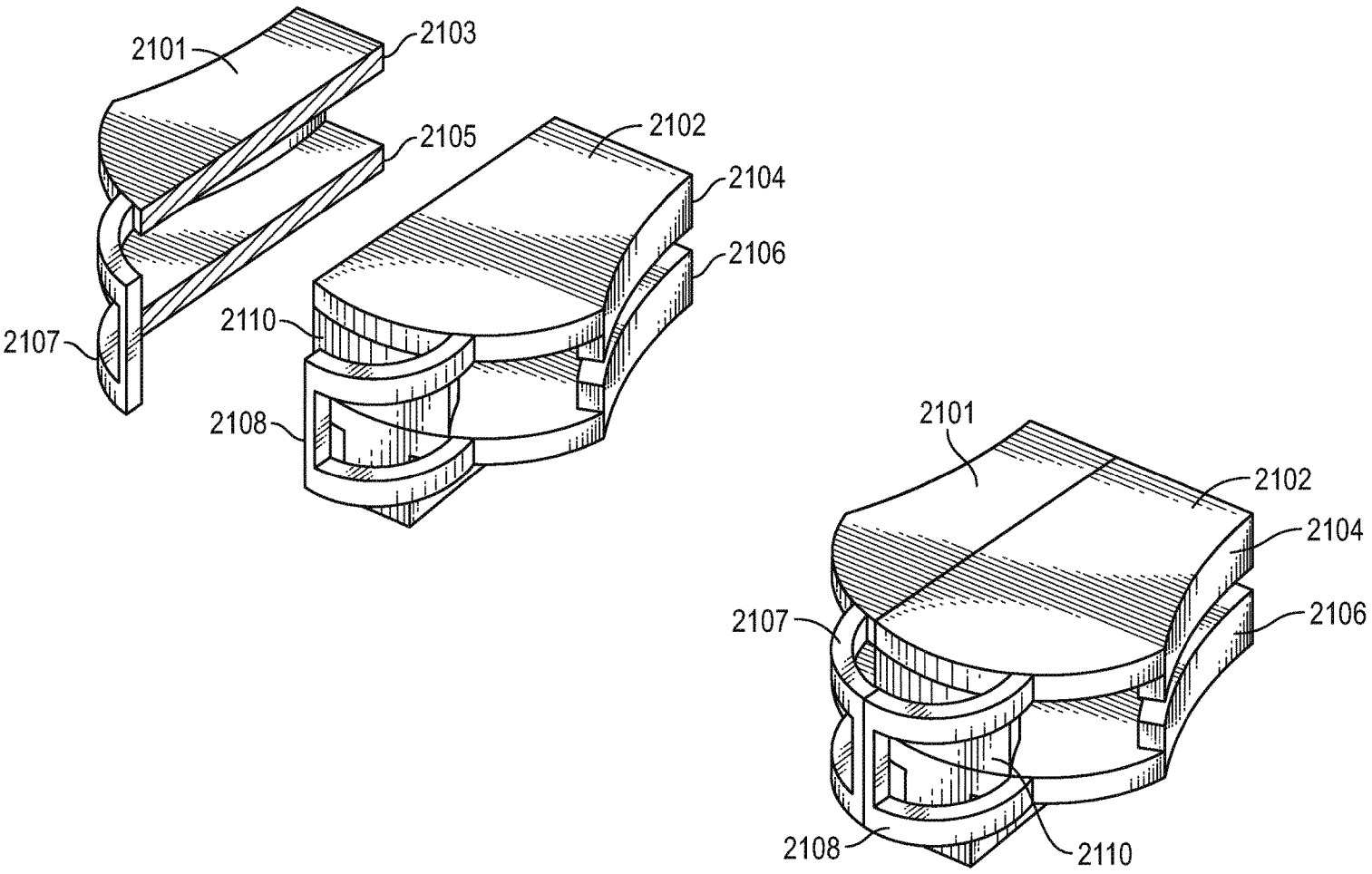
FIG. 21 illustrates an embodiment of the invention including a slider assembly with an asymmetric configuration, including a splitter and an external support member.

FIG. 21 displays a perspective exploded view of an embodiment, including LHS slider 2101 and RHS slider 2102. In an embodiment, LHS slider 2101 includes LHS top piece 2103 and LHS bottom piece 2105, connected by LHS support member 2107, which is located external to LHS top piece 2103 and LHS bottom piece 2105, and which extends externally from LHS slider 2101 substantially parallel to a plane that is parallel to both LHS top piece 2103 and LHS bottom piece 2105. In an embodiment, LHS support member 2107 is configured to work in concert with LHS top piece 2103 and LHS bottom piece 2105 to help guide LHS zipper chain through LHS slider 2001.

In an embodiment, RHS slider 2102 includes RHS top piece 2104 and RHA bottom piece 2106, and RHS splitter 2110 located substantially between RHS top piece 2104 and RHS bottom piece 2106, which can serve as a connection between RHS top piece 2104 and RHS bottom piece 2106. In an embodiment RHS splitter 2110 is substantially wedge shaped, and no LHS splitter exists. In an embodiment, RHS slider 2102 includes RHS support member 2108, which is located external to RHS top piece 2104 and RHS bottom piece 2106, and which extends externally from RHS slider 2102 parallel to a plane that is parallel to both RHS bottom piece 2104 and RHS top piece 2106. In an embodiment, RHS support member 2108 is configured to work in concert with RHS top piece 2104 and RHS bottom piece 2106 to help guide RHS zipper chain through RHS slider 2002. One skilled in the art will understand that both RHS and LHS support members may be configured in any way operable to allow a slider to slide along a zipper chain.

Figure 22:
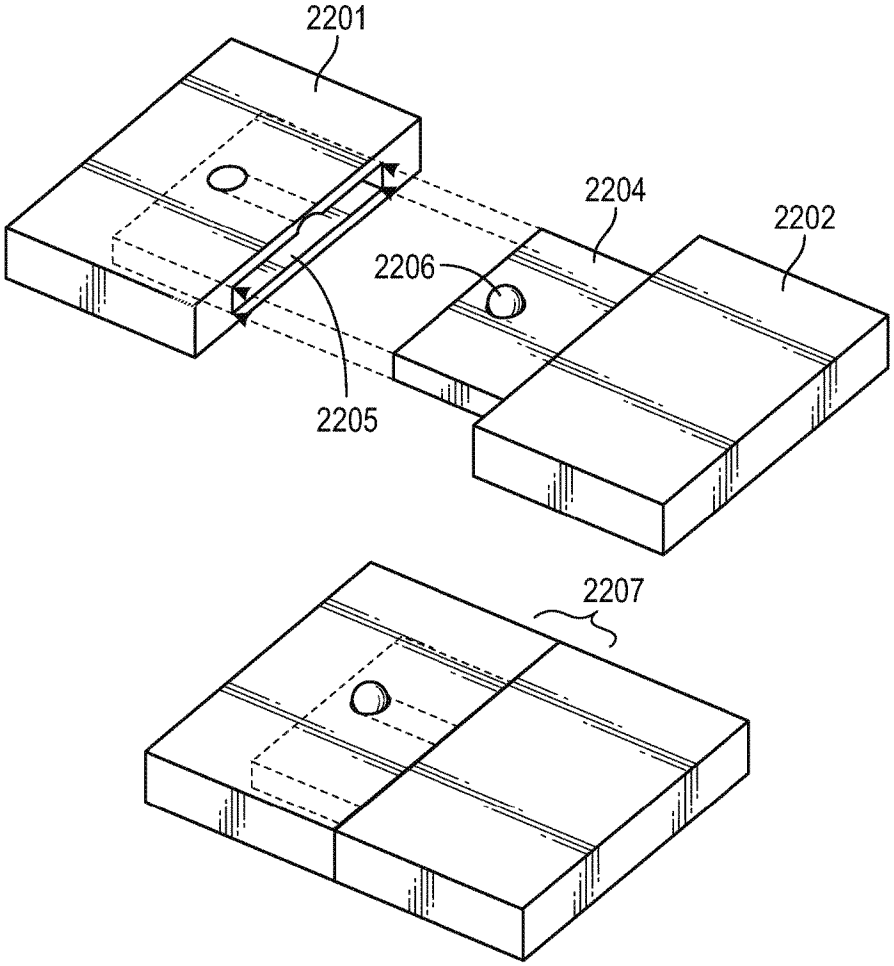
FIG. 22 illustrates an embodiment of the invention including a left-hand slider holder and right-hand slider holder, and a push-button spring activated locking pin mechanism.

FIG. 22 displays a perspective view of an embodiment of the invention, in which LHS slider holder 2201 is configured to couple with RHS slider holder 2202 by inserting tab 2204 into slot 2203. In one embodiment, tab 2204 includes a push button spring activated locking pin, 2206, which, when inserted into slot 2213, can extend through, and lock into, pin hold 2205, thus securing the two pieces together to create single slider holder 2207. As in other embodiments, the LHS and RHS slider holders can be manufactured and attached to their respective LHS and RHS sliders, or can be manufactured as a single piece, so that LHS slider holder is formed as part of an LHS slider, and the RHS slider holder is formed as a part of RHS slider. This provides for two pieces to manufacture, rather than four.

A variety of locking mechanisms to hold together the LHS slider holder and the RHS slider holder have been shown. In practice, many different types of connection can be used. For example, in some embodiments, the locking mechanism is a magnet to hold the two pieces together (see FIG. 10, numbers 1005 and 1006). In another embodiment, a magnet is used as part of tab and slot mechanism to help hold the LHS and RHS pieces together. In some embodiments, the LHS and RHS slider holder are found on a front side of LHS and RHS slider, respectively. In other embodiments, the LHS and RHS slider holders are found on the back side of the LHS and RHS slider, respectively. In some embodiments, the LHS slider holder can be located on the RHS slider, and the RHS slider holder can be located on the LHS slider.

Figure 23:
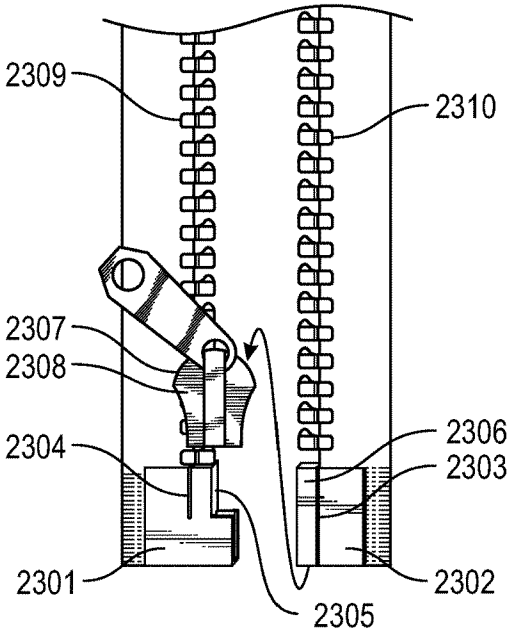
FIG. 23 illustrates an embodiment of the invention including a right-hand-side bottom stop and a left-hand-side bottom stop, and their relationship to a complete zipper mechanism, all in an open configuration.

FIG. 23 illustrates an embodiment of the invention including a right-hand-side (or RHS) bottom stop 2301, a left-hand-side (or LHS) bottom stop 2302, and their relationship to a complete zipper mechanism, all in an open configuration. In an embodiment, the RHS bottom stop 2301 is connected to a right-hand row of zipper teeth 2309 on which is mounted zipper slider 2307. Zipper slider 2307 includes zipper front face 2308. RHS bottom stop comprises RHS front face 2304 and RHS inner face 2305. LHS bottom stop 2302 is mounted on a left-hand row of zipper teeth 2310, and includes LHS front face 2303 and insertion pin 2306 configured to be placed into physical connect RHS bottom stop and LHS bottom stop.

In an embodiment, RHS front face 2304 extends beyond zipper front face 2308 of zipper slider 2307 such that a user has the ability to firmly grasp RHS bottom stop 2301, thereby allowing more control for those with limited dexterity. The extension portion can be round, oblong, rectangular, triangular, or any shape that facilitates gripping and holding in place RHS bottom stop 2301. In an embodiment, LHS front face 2303 extends beyond zipper front face 2308 on the side of zipper slider 2307 that is proximate to LHS bottom stop 2302, such that a user has the ability to firmly grasp the LHS bottom stop 2302 for insertion through zipper slider 2307 and into RHS bottom stop 2301. The extension portion can be round, oblong, rectangular, triangular, or any shape that facilitates gripping and holding in place the LHS bottom stop.

Figure 24:
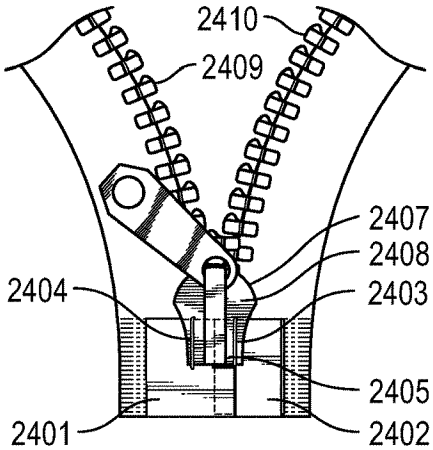
FIG. 24 illustrates an embodiment of the invention including a right-hand-side bottom stop and a left-hand-side bottom stop, and their relationship to a complete zipper mechanism, all in preparation for creating a closed configuration.

FIG. 24 illustrates an embodiment of the invention including RHS bottom stop 2401, LHS bottom stop 2402, and their relationship to a complete zipper mechanism, all in preparation for creating a closed configuration. In an embodiment, RHS bottom stop 2401 includes RHS front face 2404. LHS bottom stop 2402 includes LHS front face2403, and connects with RHS bottom stop 2401 by inserting insertion pin 2405 through an opening in zipper slider 2407 and into contact with RHS bottom stop 2401. Thus, when zipper slider 2407 is pulled away from RHS bottom stop 2401 and LHS bottom stop 2402, the two sets of zipper teeth 2409 and 2410 are forced together, thereby "zipping up" the zipper.

In an embodiment, RHS front face 2404 has a width that extends beyond slider outer face 2408 such that a user has the ability to firmly grasp RHS bottom stop 2401. In an embodiment, LHS front face 2403 extends beyond slider outer face 2408 on the side that is proximate to LHS bottom stop 2402, such that a user has the ability to firmly grasp the LHS bottom stop 2302 for insertion through zipper slider 2407 and into RHS bottom stop 2401. Once inserted, as shown in the embodiment in FIG. 24, the combined dimensions of RHS bottom stop 2401 and LHS bottom stop 2402 allow a user, particularly a user with limited dexterity, to more firmly grasp the combined mechanism in preparation for zipping up the zipper.

Figure 25:
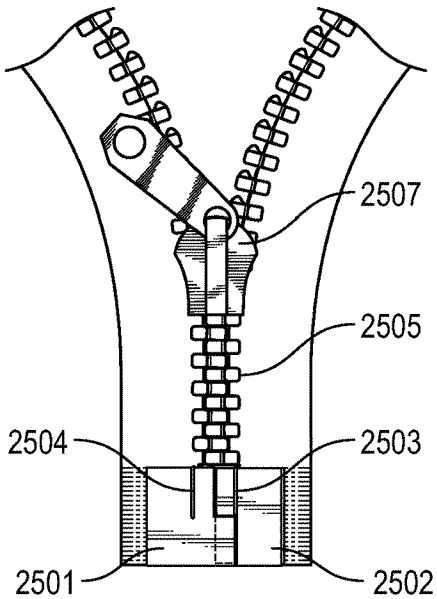
FIG. 25 illustrates an embodiment of the invention including a right-hand-side bottom stop and a left-hand-side bottom stop, and their relationship to a complete zipper mechanism, all in a closed configuration.

FIG. 25 illustrates an embodiment of the invention including RHS bottom stop and LHS bottom stop, and their relationship to a complete zipper mechanism, all in a closed configuration. In an embodiment, RHS bottom stop 2501 is placed in contact with LHS bottom stop 2502 by inserting insertion pin 2503 through a side of the zipper slider proximate to LHS bottom stop 2502, and then into a groove in the inner face of RHS bottom stop 2501. Once RHS bottom stop 2501 and LHS bottom stop 2502 are connected, zipper slider 2507 can be pulled up, forcing together the two zipper chains creating a single "zipped up" zipper chain 2505.

In an embodiment, the combined dimensions of RHS bottom stop 2501 and LHS bottom stop 2502 allow a user, including a user with limited dexterity, to more firmly grasp the combined mechanism as the zipper slider is pulled upward, zipping up the zipper, thereby providing increased ability to hold the combined mechanism in place to allow ease of zippering.

Figure 26:
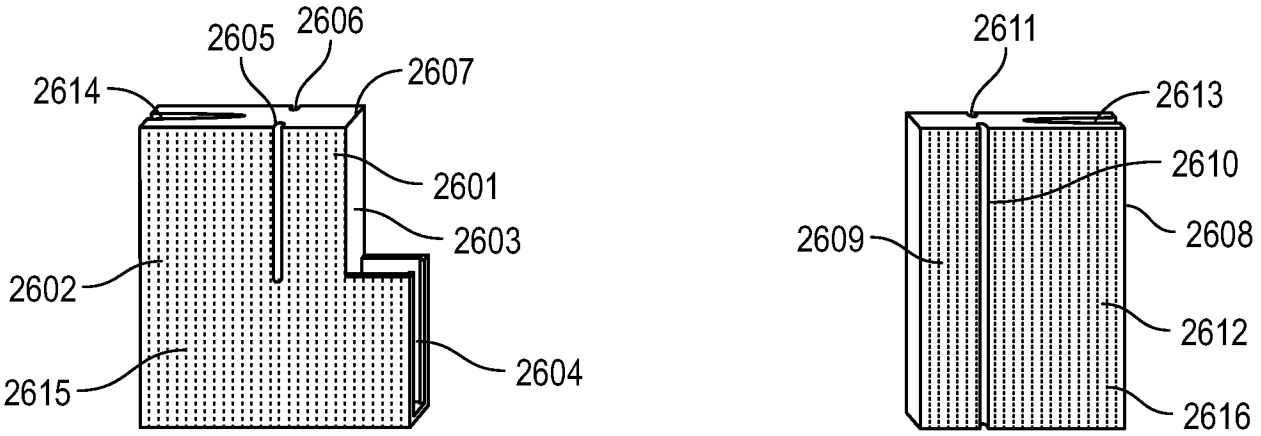
FIG. 26 illustrates an embodiment of the invention including a perspective view of a right-hand-side bottom stop including a slot for receiving an insertion pin, and a perspective view of a left-hand-side bottom stop including an insertion pin.

FIG. 26 illustrates an embodiment of the invention including a perspective view of a right-hand-side bottom stop including a slot for receiving an insertion pin, and a perspective view of a left-hand-side bottom stop including an insertion pin. In an embodiment, RHS bottom stop 2601 includes RHS front face 2602, and RHS inner face 2603, which is configured to connect with LHS bottom stop 2608. In an embodiment, RHS left face 2603 includes slot 2604, which is configured to receive a insertion pin 2609, thereby connecting LHS bottom stop 2608 to RHS bottom stop 2601. In an embodiment, RHS bottom stop 2601 is substantially front and back symmetric, such that RHS bottom stop includes RHS rear face (not shown) substantially identical to and opposite from RHS front face 2602. In an embodiment, slot 2604 is defined by RHS front face 2602 and RHS rear face extending beyond at least a lower portion of RHS inner face 2603. In an embodiment, RHS front face 2602 includes a textured grip portion (not shown), thereby making it easier to grip for a person with limited manual dexterity.

In an embodiment, RHS front face includes RHS front groove 2605 extending from RHS top 2607 down to a predetermined distance from RHS top 2607 along RHS front face 2602. RHS rear face includes RHS rear groove 2606 extending from RHS top 2607 down to the same predetermined distance from RHS top. In other words, solely as an example, if RHS front groove 2605 is 0.5 cm long, then RHS rear groove 2606 is also 0.5 cm long. RHS front groove 2605 and RHS rear groove 2606 are configured to allow a zipper slider to slide along RHS bottom stop 2601 until it contacts the bottom of each groove, thereby stopping the slider from sliding further down. In an embodiment, RHS front groove 2605 and RHS rear groove 2606 are placed along RHS front face 2602 and RHS rear face such that a zipper slider, when lowered into position against RHS bottom stop 2601, the right-hand edge of the zipper slider slides into RHS front groove 2605 and RHS rear groove 2606 and is stopped when it hits the end of the groove that farthest from RHS top 2607 (the bottom of the groove).

In an embodiment, LHS bottom stop 2608 includes insertion pin 2609 on the side proximal to RHS bottom stop 2601, and is configured to fit into slot 2604. In an embodiment, LHS bottom stop 2608 includes LHS front groove 2610 in LHS front face 2612 and LHS rear groove 2611 in LHS rear face (not shown). LHS rear groove 2611 is placed in LHS rear face directly opposite LHS front groove 2610 such that together, LHS front groove 2610 and LHS rear groove 2611 define insertion pin 2609. Front groove 2610 and rear groove 2611 are configured to allow a zipper slider to slide along LHS bottom stop 2608. In an embodiment, insertion pin 2609 extends outward beyond LHS front face 2602 and LHS rear face. In an embodiment, LHS front groove 2610 and rear groove 2611 are placed along LHS front face 2612 and LHS rear face such that a zipper slider, when lowered into position against LHS bottom stop 2608, the left-hand edge of the slider slides into the groove. In an embodiment, LHS front face 2612 includes a textured portions 2615 and 2617, thereby making it easier to grip by a person with limited manual dexterity.

RHS bottom stop 2601 includes opening 2614 configured to receive a right-hand tape, thereby connecting RHS bottom stop 2601 to the rest of the zipper mechanism. Likewise, LHS bottom stop 2608 includes opening 2613 to receive a left-hand tape thereby connecting LHS bottom stop 2608 to the rest of the zipper mechanism. One skilled in the art will understand that any known practicable method of connecting a bottom stop to a zipper tape may be used.

Figure 27:
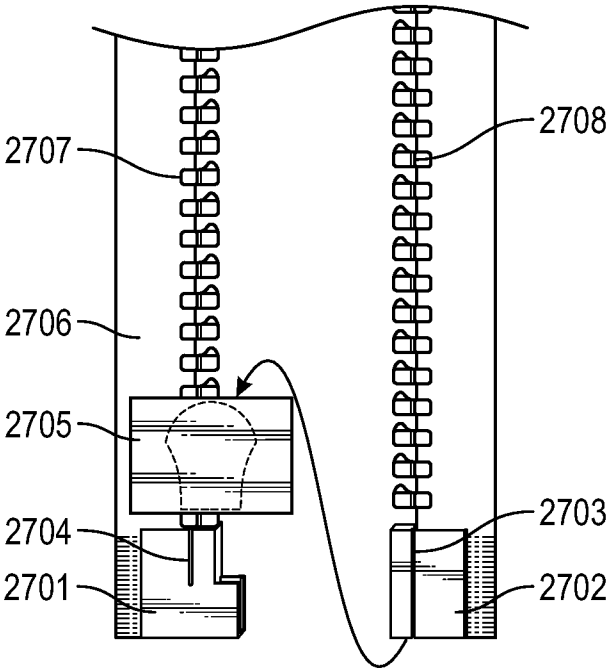
FIG. 27 illustrates an embodiment of the invention including a slider holder in contact with a zipper slider.

FIG. 27 illustrates an embodiment of the invention including a slider holder in contact with a zipper slider. In an embodiment, slider holder 2705 is coupled to zipper slider 2706 (shown in dotted line behind slider holder 2705) and is configured to move up and down along zipper chains 2707 and 2708. In an embodiment, slider holder 2705 is typically larger and easier to grip than zipper slider 2706. In an embodiment, slider holder 2705 is larger in the left-right direction than zipper slider 2706. In an embodiment, slider holder 2705 is larger in the top-bottom direction than zipper slider 2706. In an embodiment, slider holder 2705 includes a textured grip, thereby making it easier to grip than zipper slider 2706.

FIGS. 28 through 32 illustrate embodiments of the invention that include slider holders of various shapes to improve a user's ability to grip the slider holder.

Figure 28:
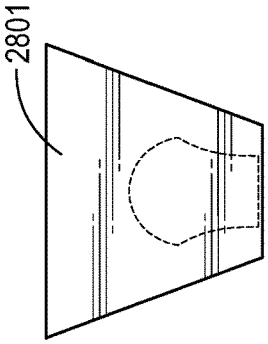
FIG. 28 illustrates an embodiment of the invention that includes a substantially trapezoid-shaped slider holder.

FIG. 28 illustrates an embodiment of the invention that includes a substantially trapezoid-shaped slider holder. In an embodiment, slider holder 2801 is configured to be mounted on a zipper slider (shown in dotted-line underneath slider holder 2801, and not numbered), and is substantially trapezoid shaped. In an embodiment, slider holder 2801 includes a textured portion for ease of grip.

Figure 29:
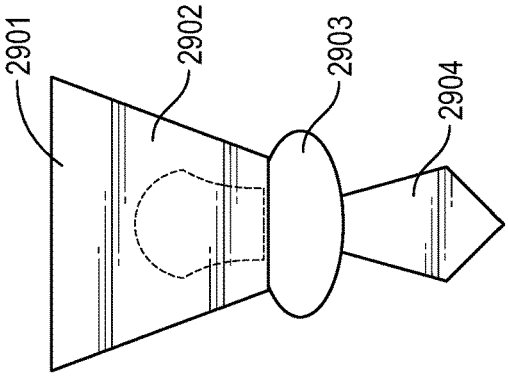
FIG. 29 illustrates an embodiment of the invention that includes a slider holder with a substantially trapezoid-shaped portion and an extension below the substantially trapezoid-shaped portion.

FIG. 29 illustrates an embodiment of the invention that includes a slider holder with a substantially trapezoid-shaped portion and an extension below the substantially trapezoid-shaped portion. In an embodiment, slider holder 2901 includes substantially trapezoid-shaped portion 2902, and includes substantially oval-shaped extension 2903 connected along the bottom edge of substantially trapezoid-shaped portion 2902, and substantially elongated-trapezoid-shaped extension 2904 connected along the bottom edge of substantially oval-shaped extension 2903. In an embodiment, elongated-trapezoid-shaped extension 2903 is fixedly connected to oval-shaped extension 2902. In an embodiment, elongated-trapezoid-shaped extension 2903 is movably connected to oval-shaped extension 2902. In an embodiment, elongated-trapezoid-shaped extension is configured to move side to side along substantially oval-shaped extension 2902. In an embodiment, slider holder 2901 includes a textured portion for ease of grip. The textured portion (not shown) can be included on substantially trapezoid-shaped portion 2902, on substantially oval-shaped portion 2903, or on substantially elongated-trapezoid-shaped portion, 2904, or any combination thereof.

Figure 30:
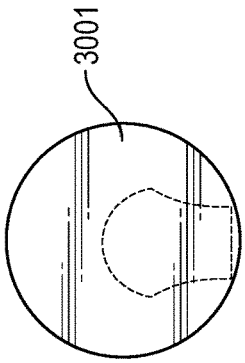
FIG. 30 illustrates an embodiment of the invention that includes a substantially circular-shaped slider holder.

FIG. 30 illustrates an embodiment of the invention that includes a substantially circular-shaped slider holder. In an embodiment, substantially circular-shaped slider holder 3001 is mounted on a zipper slider (shown in dotted-line underneath slider holder 3001, and not numbered) in which slider holder 3001 is substantially circular shaped. In an embodiment, slider holder 3001 includes a textured portion for ease of grip.

Figure 31:
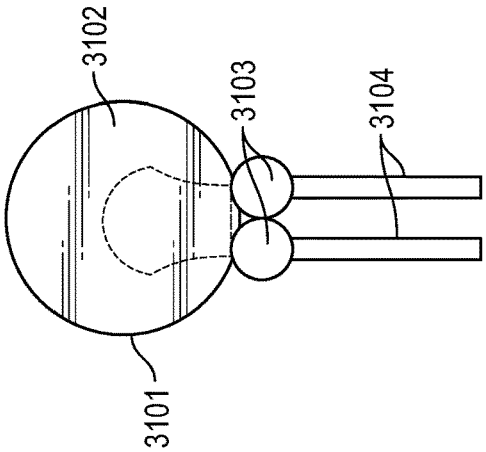
FIG. 31 illustrates an embodiment of the invention that includes a slider holder with a substantially circular-shaped portion and tassel-like extensions below the substantially circular-shaped portion.

FIG. 31 illustrates an embodiment of the invention that includes a slider holder with a substantially circular-shaped portion and tassel-like extensions below the substantially circular-shaped portion. In an embodiment, slider holder 3101 includes substantially circular-shaped portion 3102 extended using spherical tops 3103 and elongated bottoms 3104. The combination of spherical tops 3103 and elongated bottoms 3103 hang below substantially circular-shaped portion 3102 creating two tassels. In an embodiment, slider holder 3101 includes a textured portion for ease of grip. The textured portion (not shown) can be included on substantially circular-shaped portion 3102, on one or both of tassel-shaped connectors 3103 and 3104, or any combination thereof.

Figure 32:
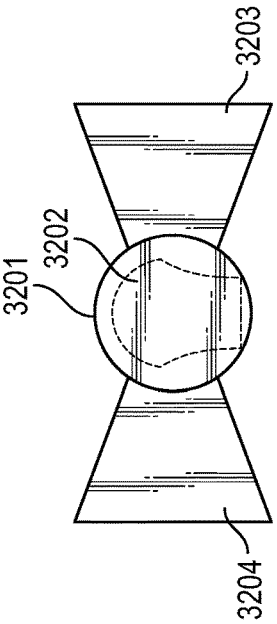
FIG. 32 illustrates an embodiment of the invention that includes a slider holder with a substantially circular-shaped portion flanked on both sides by a substantially trapezoid-shaped left wing and a substantially trapezoid-shaped right wing.

FIG. 32 illustrates an embodiment of the invention that includes a slider holder with a substantially circular-shaped portion flanked on both sides by a substantially trapezoid-shaped left wing and a substantially trapezoid-shaped right wing. In an embodiment, slider holder 3201 includes substantially circular-shaped portion 3202, and includes substantially wing-shaped extension 3203 extending leftward from substantially circular-shaped portion 3202, substantially wing-shaped extension 3204 extending rightward from substantially circular-shaped portion 3202.

Figure 33:
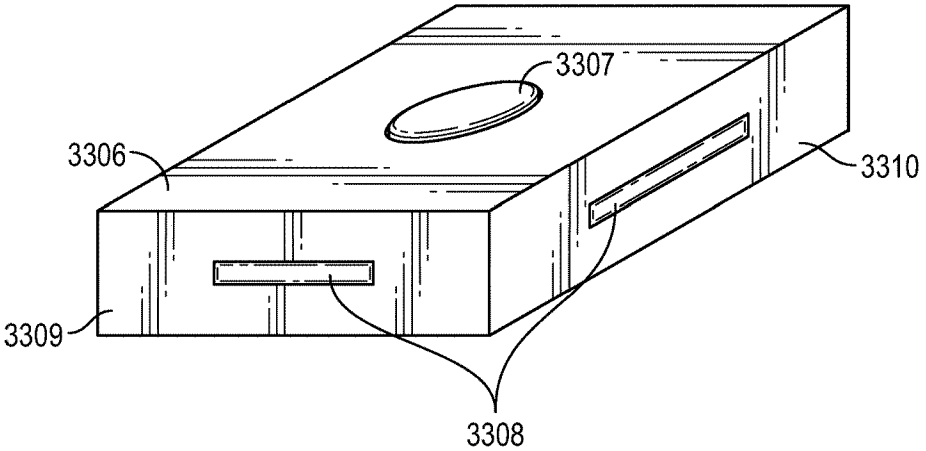
FIG. 33 illustrates an embodiment of the invention including a perspective view of a slider holder containing an actuator button and two light sources.

FIG. 33 illustrates an embodiment of the invention including a perspective view of a slider holder containing an actuator button and two light sources. In an embodiment slider holder 3306 is bounded by a housing that includes light sources 3308, one on bottom face 3309, and one on outer face 3310. One skilled in the art will understand that, while two light sources are shown, any practicable number and combination of light sources can be included on any part of the slider holder. In an embodiment, slider holder 3306 further includes an actuator button that, when depressed, activates one or more of light sources 3308. In an embodiment, light sources 3308 are internal to, or flush with bottom face 3309 and outer face 3310. In an embodiment, light sources 3308 extend beyond bottom face 3309 and outer face 3310.

In an embodiment, the electronics (not shown) that support light sources 3308, and place them in communication with actuator button 3307, are internal to the housing that defines the outside of slider holder 3306. Light sources 3308 can be any practicable light source, such as halogen, LED, LCD, and others. In an embodiment light sources 3308 are driven by a battery contained in a cavity within the housing (not shown). In an embodiment, the housing includes a removable access such that the battery can be accessed and changed. In an embodiment, light sources 3308 are driven by a photovoltaic panel (not shown).

Figure 34:
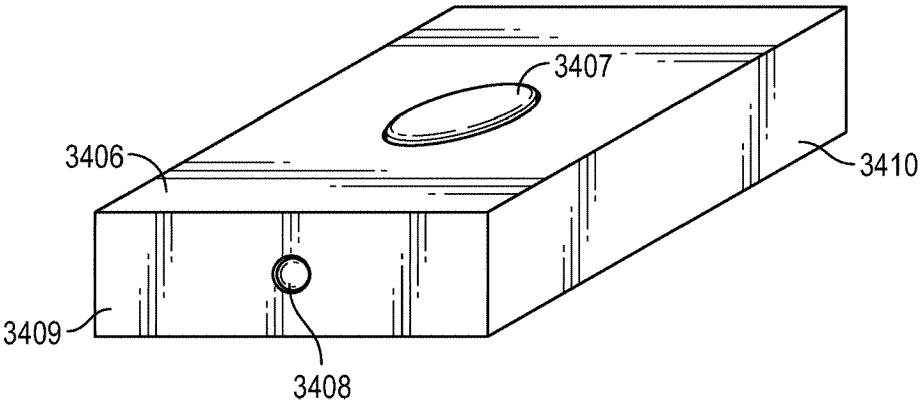
FIG. 34 illustrates an embodiment of the invention including a perspective view of a slider holder containing an actuator button and a single light source.

FIG. 34 illustrates an embodiment of the invention including a perspective view of a slider holder containing an actuator button and a single light source. In an embodiment slider holder 3406 includes a light source 3408. In an embodiment, light source 3408 is located on bottom face 3409. In an embodiment, light source 3408 is located on outer face 3310. Light sources 3308 can be any practicable light source, such as halogen, LED, LCD, and others.

In an embodiment, slider holder 3406 further includes an actuator button that, when depressed, activates light source 3408. In an embodiment, light source 3408 is internal to flush, or extends beyond, with bottom face 3409. In an embodiment, light source 3408 is internal to, flush with, or extends beyond, outer face 3410. One skilled in the art will appreciate that light source 3408 can be found on any face of slider holder 3406.

In an embodiment, the electronics (not shown) that support light source 3408, and place them in communication with actuator button 3407, are internal to slider holder 3406. In an embodiment light source 3408 is driven by an internal battery (not shown). In an embodiment, light source 3408 is driven by a photovoltaic panel (not shown).

Figure 35:
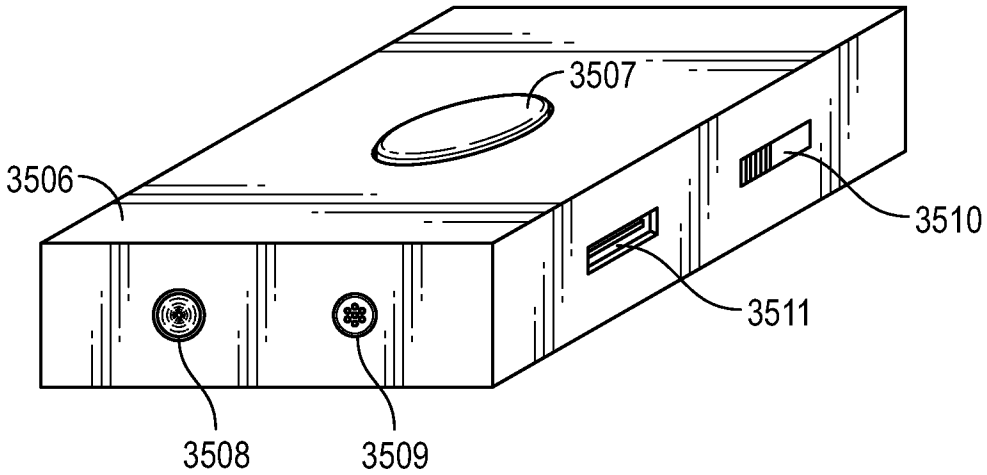
FIG. 35 illustrates an embodiment of the invention including a perspective view of a slider holder containing an actuator button, a speaker, a microphone, a battery-charger port, and an on/off switch.

FIG. 35 illustrates an embodiment of the invention including a perspective view of a slider holder containing an actuator button, a speaker, a microphone, a battery-charger port, and an on/off switch. In an embodiment, slider holder 3506 is bounded by a housing that defines the external shape of slider holder 3506, and includes actuator button 3507, speaker 3508, and microphone 3509. Actuator button 3507, when depressed, can activate any combination of speaker 3508 and microphone 3509. In an embodiment, slider holder 3506 is bounded by a housing that surrounds the electronic circuits to support each of the listed components, and that puts them in communication with one another. In an embodiment, slider holder 3506 includes at least one of GPS technology for locating slider holder 3506 (and, by extension, a person such as a young child wearing clothing that includes slider holder 3506), and wireless communication electronics for connecting the functionality contained in the electronic components to a network and/or a device. For example, such wireless communication electronics can include electronics for Wi-Fi connectivity, Bluetooth connectivity, and any other practicable means of wirelessly connecting the components of the slider holder 3506 to a network or a device.

In an embodiment, actuator button 3507 can, when depressed, activate a wireless alarm that can be received on another device, or can play through speaker 3508. In an embodiment, actuator button 3507 can, when depressed, activate speaker 3508 and/or microphone 3509. In an embodiment, actuator button 3507 can, when pressed, initiate or answer a telephone via a mobile device coupled to slider holder 3506. In an embodiment, speaker 3508 is voice activated and is coupled to a smartphone or other mobile device to allow for hands-free operation. Such coupling can be achieved via Bluetooth, Wi-Fi, or any other practicable wireless connection. In an embodiment, slider holder 3506 is coupled to a smartphone or other mobile device via a wired connection.

In an embodiment, slider holder 3506 includes battery-charging port 3511, and on/off button 3510. Battery charging port can be any type of USB, Firewire, Lighting connector, or any other known and practicable charging port that can create an electrical connection between battery-charging port 3511 and a power-charging source.

One skilled in the art will understand that, for the purposes of the present invention, the electronics and electrical components discussed above may be placed into a slider holder, but in another embodiment, the electronics and electrical components may also be placed into a RHS slider holder or a LHS slider holder, or any practicable portion of a divided slider holder.

One skilled in the art will understand that, for the purposes of the present invention, the various components described herein can be constructed from any practicable material, including nylon, aluminum, and others. In addition, one skilled in the art will understand that the slider holder can be any size, providing certain advantages when the slider holder is made larger, such as make the slider holder easier to grasp. One skilled in the art will appreciate that the slider holder can be of any size and shape appropriate for grasping and manipulating.

One skilled in the art will understand that the terms LHS and RHS stand for "left-hand side" and "right-hand side," LHS slider is synonymous with the term left-hand slider and left-hand side slider, RHS slider is synonymous with the term right-hand slider and right-hand side slider, LHS slider holder is synonymous with the term left-hand slider holder and left-hand side slider holder, and RHS slider holder is synonymous with the term right-hand slider holder and right-hand side slider holder One skilled in the art will appreciate that distinguishing left from right is not meant to be limiting, but rather to distinguish one side from the other. Thus, any RHS slider, chain, bottom stop, can be called an LHS slider, chain, bottom stop, as long as it is distinguished from its counterpart on the other side of the zipper. For the purposes of the present invention, one skilled in the art will understand that LHS and RHS are simply labels to distinguish the two sides. The terms "left" and "right" can be exchanged without limiting or altering the spirit of the invention.

Although specific features of the invention are shown in some drawings and not in others, this is for convenience only as each feature may be combined with any or all of the other features in accordance with the invention. The words "including," "comprising," "having," and "with," as used herein, are to be interpreted broadly and comprehensively. Moreover, any embodiments disclosed in the subject application are not to be taken as the only possible embodiments.

I claim:

1. An apparatus for joining two pieces of material, comprising:

a right-hand-side bottom stop including a right-hand-side front face and a right-hand-side inner face, the right-hand-side inner face including a slot configured to receive an insertion pin;

a left-hand-side bottom stop including a left-hand-side front face and a left-hand side inner face positioned as a face closest to and facing the right-hand side inner face, the left-hand side inner face including an insertion pin configured to be inserted into the right-hand-side inner face;

a slider with an outer-face, the slider coupled to a zipper chain in a way that allows the slider to slide toward and away from the right-hand-side bottom stop;

the right-hand-side front face having a portion that extends beyond the outer-face of the slider.

2. The apparatus of claim 1, wherein the portion that extends beyond the outer-face of the slider includes a textured portion configured to facilitate gripping by hand.

3. The apparatus of claim 1, wherein the left-hand-side front face includes a portion that extends beyond the outer-face of the slider.

4. The apparatus of claim 1, wherein the right-hand-side front face can have a shape that is at least one of substantially rectangular, substantially round, and substantially oblong.

5. The apparatus of claim 3, wherein the left-hand-side front face can have a shape that is at least one of substantially rectangular, substantially round, and substantially oblong.

6. The apparatus of claim 3, wherein the left-hand-side front face portion that extends beyond the outer-face width of the slider includes a textured portion.

7. An apparatus for joining two pieces of material, comprising:

a left-hand side slider configured to slide along a left-hand side zipper teeth, the left-hand side slider including a left-hand side top piece, a left-hand side bottom piece, and a left-hand side splitter between and in contact with both the left-hand side top piece and the left-hand side bottom piece such that the left-hand side top piece is fixedly coupled to the left-hand side bottom piece by the left-hand side splitter;

a right-hand side slider configured to slide along a right-hand side zipper teeth, the right-hand side slider including a right-hand side top piece, a right-hand side bottom piece, and a right-hand side splitter between and in contact with both the right-hand side top piece and the right-hand side bottom piece such that the right-hand side top piece is fixedly coupled to the right-hand side bottom piece by the right-hand side splitter;

the left-hand side slider and right-hand side slider further configured to be substantially in contact with each other such that they are capable of sliding substantially in unison along the left-hand side zipper teeth and right-hand side zipper teeth such that, when slid in one direction in unison, the left-hand side slider and right-hand side slider will mechanically connect the left-hand side zipper teeth to the right-hand side zipper teeth, and when moved in another direction in unison, will mechanically disconnect the left-hand side zipper teeth from the right-hand side zipper teeth;

a slider holder coupled to at least one of the left-hand side slider and the right-hand side slider and configured to include a housing with a front face, a bottom face, and an inner face;

at least one light source placed on at least one of the front face, the bottom face, and the inner face;

an actuator button electrically coupled to the at least one light source, and placed on at least one of the front face, the bottom face, and the inner face.

8. The apparatus of claim 7, further comprising electrical circuitry located within the housing and coupled to the actuator button and the at least one light source, and wherein the housing includes a battery cavity configured to place a battery in electrical communication with the electrical circuitry.

9. The apparatus of claim 8, wherein the housing includes a removable access to the battery cavity.

10. An apparatus for joining two pieces of material, comprising:

a left-hand side slider configured to slide along a left-hand side zipper teeth, the left-hand side slider including a left-hand side top piece, a left-hand side bottom piece, and a left-hand side splitter between and in contact with both the left-hand side top piece and the left-hand side bottom piece such that the left-hand side top piece is fixedly coupled to the left-hand side bottom piece by the left-hand side splitter;

a right-hand side slider configured to slide along a right-hand side zipper teeth, the right-hand side slider including a right-hand side top piece, a right-hand side bottom piece, and a right-hand side splitter between and in contact with both the right-hand side top piece and the right-hand side bottom piece such that the right-hand side top piece is fixedly coupled to the right-hand side bottom piece by the right-hand side splitter;

the left-hand side slider and right-hand side slider further configured to be substantially in contact with each other such that they are capable of sliding substantially in unison along the left-hand side zipper teeth and right-hand side zipper teeth such that, when slid in one direction in unison, the left-hand side slider and right-hand side slider will mechanically connect the left-hand side zipper teeth to the right-hand side zipper teeth, and when moved in another direction in unison, will mechanically disconnect the left-hand side zipper teeth from the right-hand side zipper teeth;

a slider holder coupled to at least one of the left-hand side slider and the right-hand side slider, and configured to include a housing with an inside and an outside;

at least one of a speaker, a microphone, and an on/off switch placed on the outside of the housing; and an actuator button electrically coupled to the at least one of a speaker, a microphone, and an on/off switch and configured to, when depressed, activate the at least one of the speaker, the microphone, and the on/off switch.

11. The apparatus of claim 10, further including a battery contained within the housing, and a battery-charger connector electrically coupled to the battery.

12. The apparatus of claim 11, wherein the battery-charger connector is a USB-type connector.

13. The apparatus of claim 10, further including a GPS device configured, when switched on, to be in communication with a mobile device.

14. The apparatus of claim 10, further including a Bluetooth transceiver configured, when switched on, to place the at least one of a speaker and a microphone in communication with a mobile device.

* * * * *